US006915766B2

(12) United States Patent
Aoyama et al.

(10) Patent No.: US 6,915,766 B2
(45) Date of Patent: Jul. 12, 2005

(54) COMPRESSION RATIO CONTROLLING APPARATUS AND METHOD FOR SPARK-IGNITED INTERNAL COMBUSTION ENGINE

(75) Inventors: Shunichi Aoyama, Kanagawa (JP); Shinichi Takemura, Yokohama (JP); Takanobu Sugiyama, Yokohama (JP); Ryosuke Hiyoshi, Kanagawa (JP); Toru Noda, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 20 days.

(21) Appl. No.: 10/615,387

(22) Filed: Jul. 9, 2003

(65) Prior Publication Data

US 2004/0069254 A1 Apr. 15, 2004

(30) Foreign Application Priority Data

Jul. 11, 2002 (JP) ..... 2002-202138
Jul. 2, 2003 (JP) ..... 2003-189928

(51) Int. Cl.[7] ..... F02B 75/04; F02P 5/15
(52) U.S. Cl. ..... 123/78 E; 123/78 F; 123/406.29
(58) Field of Search ..... 123/78 E, 78 F, 123/48 B, 197.4, 406.29, 406.76

(56) References Cited

U.S. PATENT DOCUMENTS 6,505,582 B2 1/2003 Moteki et al.
6,516,757 B2 2/2003 Aoyama et al.
6,769,404 B2 * 8/2004 Aoyama et al. ..... 123/406.29

FOREIGN PATENT DOCUMENTS

| | | | |
|---|---|---|---|
| DE | 195 04 735 | A1 | 8/1996 |
| EP | 1 160 430 | A2 | 12/2001 |
| EP | 1 167 720 | A1 | 1/2002 |
| EP | 1 170 482 | A2 | 1/2002 |
| JP | 1-163468 | A | 6/1989 |
| JP | 2001-271664 | A | 10/2001 |
| JP | 2002-21592 | A | 1/2002 |

* cited by examiner

*Primary Examiner*—Henry C. Yuen
*Assistant Examiner*—Hyder Ali
(74) *Attorney, Agent, or Firm*—Foley & Lardner LLP

(57) ABSTRACT

In a compression ratio controlling apparatus and method for a spark-ignited internal combustion engine, the variable compression ratio mechanism is controlled by a compression controlling section on the basis of a detected engine speed and engine load in such a manner that the compression ratio is varied toward a target high compression ratio when the engine load falls in a predetermined low load region and toward a target low compression ratio when the engine load falls in a predetermined high load region and a predetermined delay is provided in a variation in the compression ratio toward one of the target high and low compression ratios in accordance with at least one of an engine driving history immediately before a transient state of a change in the engine load occurs and a wall temperature of a combustion chamber of the engine immediately before the transient state thereof occurs.

21 Claims, 20 Drawing Sheets

LOW COMPRESSION RATIO POSITION

HIGH COMPRESSION RATIO POSITION

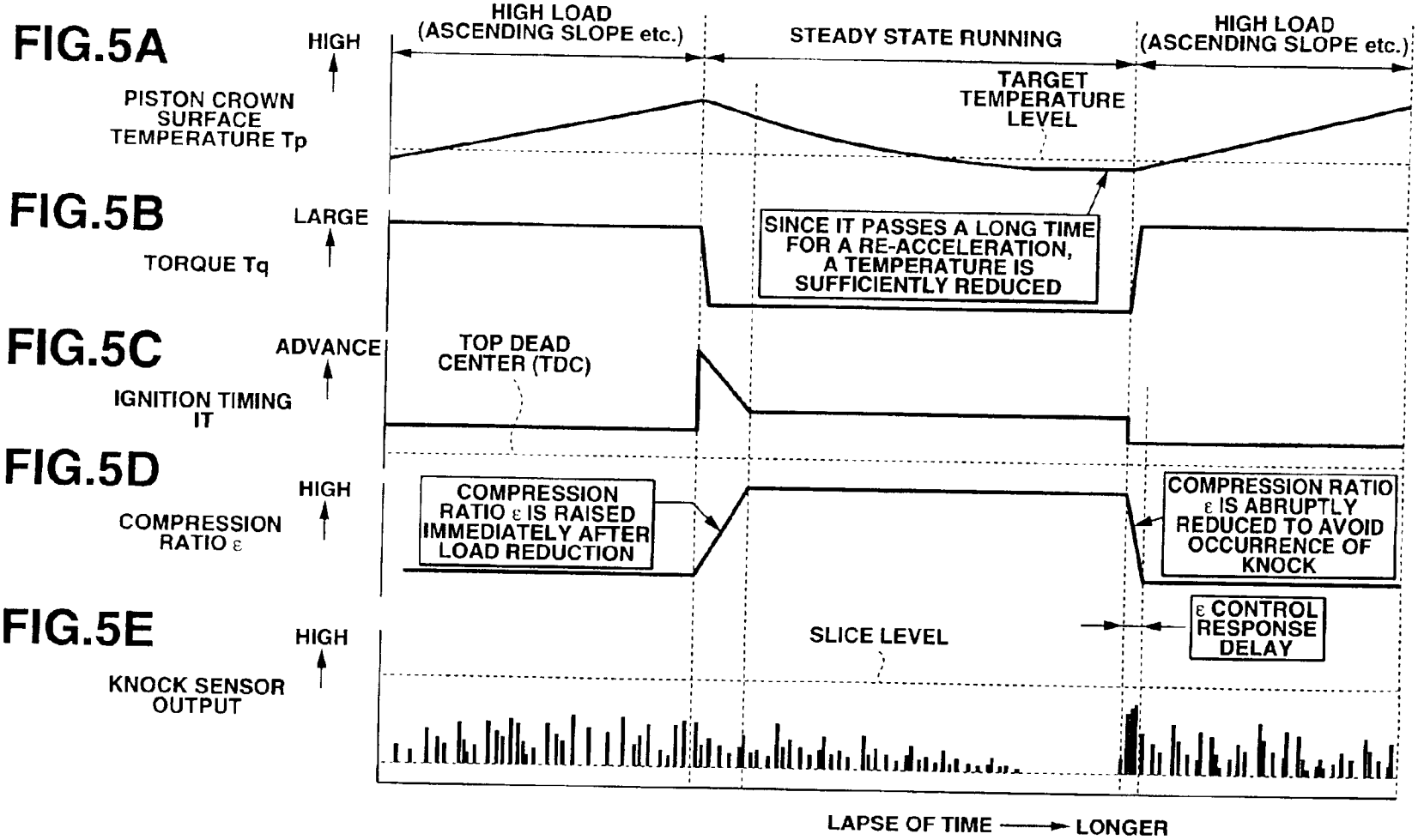
HIGH LOAD (ASCENDING SLOPE etc.)
STEADY STATE RUNNING
HIGH LOAD (ASCENDING SLOPE etc.)
TARGET TEMPERATURE LEVEL
SINCE IT PASSES A LONG TIME FOR A RE-ACCELERATION, A TEMPERATURE IS SUFFICIENTLY REDUCED
TOP DEAD CENTER (TDC)
COMPRESSION RATIO ε IS ABRUPTLY REDUCED TO AVOID OCCURRENCE OF KNOCK
ε CONTROL RESPONSE DELAY
COMPRESSION RATIO ε IS RAISED IMMEDIATELY AFTER LOAD REDUCTION
SLICE LEVEL
LAPSE OF TIME → LONGER
FIG.5A
HIGH
PISTON CROWN SURFACE TEMPERATURE Tp
FIG.5B
LARGE
TORQUE Tq
FIG.5C
ADVANCE
IGNITION TIMING IT
FIG.5D
HIGH
COMPRESSION RATIO ε
FIG.5E
HIGH
KNOCK SENSOR OUTPUT

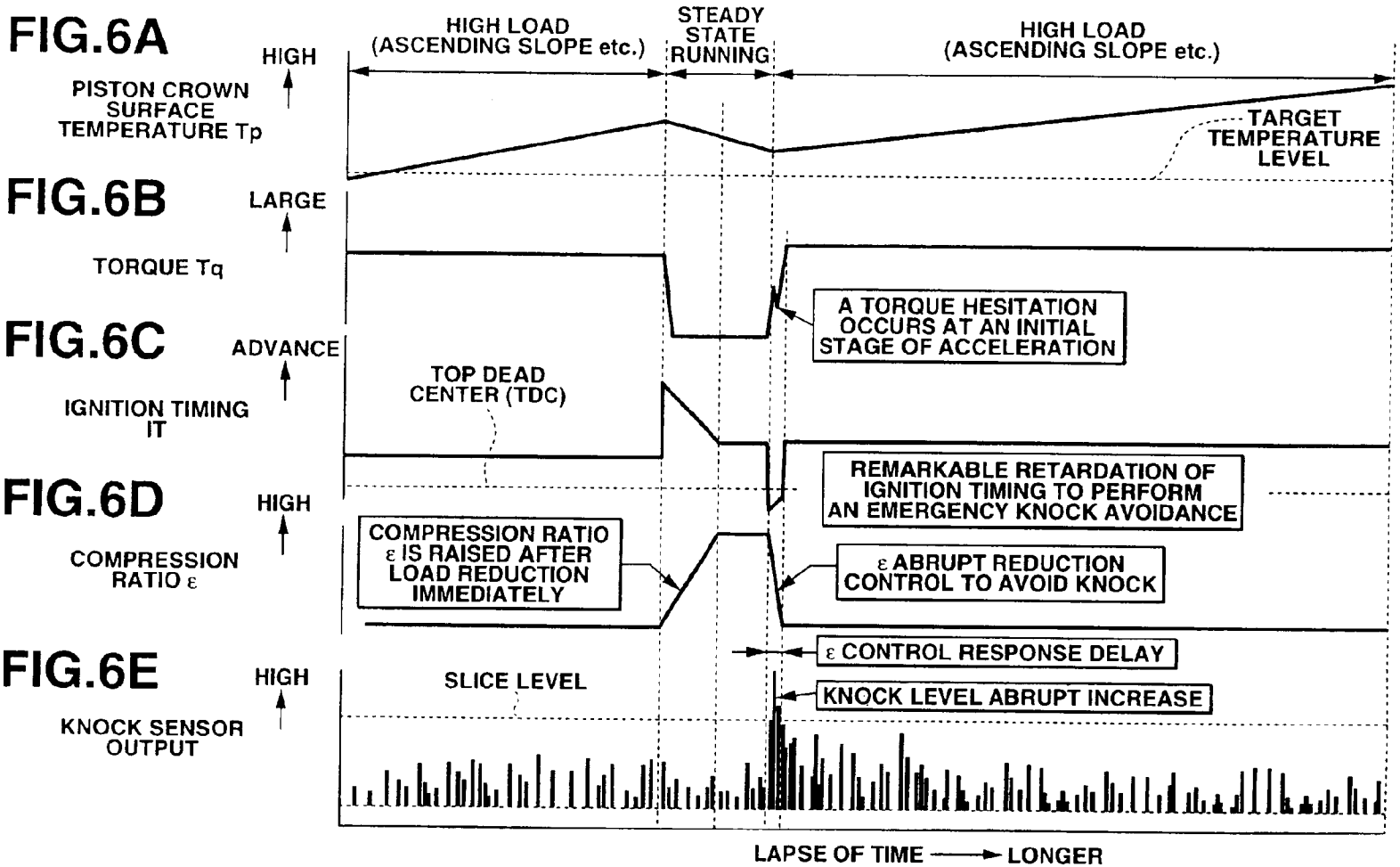
HIGH LOAD (ASCENDING SLOPE etc.)
STEADY STATE RUNNING
HIGH LOAD (ASCENDING SLOPE etc.)
TARGET TEMPERATURE LEVEL
A TORQUE HESITATION OCCURS AT AN INITIAL STAGE OF ACCELERATION
REMARKABLE RETARDATION OF IGNITION TIMING TO PERFORM AN EMERGENCY KNOCK AVOIDANCE
ε ABRUPT REDUCTION CONTROL TO AVOID KNOCK
ε CONTROL RESPONSE DELAY
KNOCK LEVEL ABRUPT INCREASE
TOP DEAD CENTER (TDC)
COMPRESSION RATIO ε IS RAISED AFTER LOAD REDUCTION IMMEDIATELY
SLICE LEVEL
LAPSE OF TIME → LONGER
FIG.6A
PISTON CROWN SURFACE TEMPERATURE Tp
HIGH
FIG.6B
TORQUE Tq
LARGE
FIG.6C
IGNITION TIMING IT
ADVANCE
FIG.6D
COMPRESSION RATIO ε
HIGH
FIG.6E
KNOCK SENSOR OUTPUT
HIGH

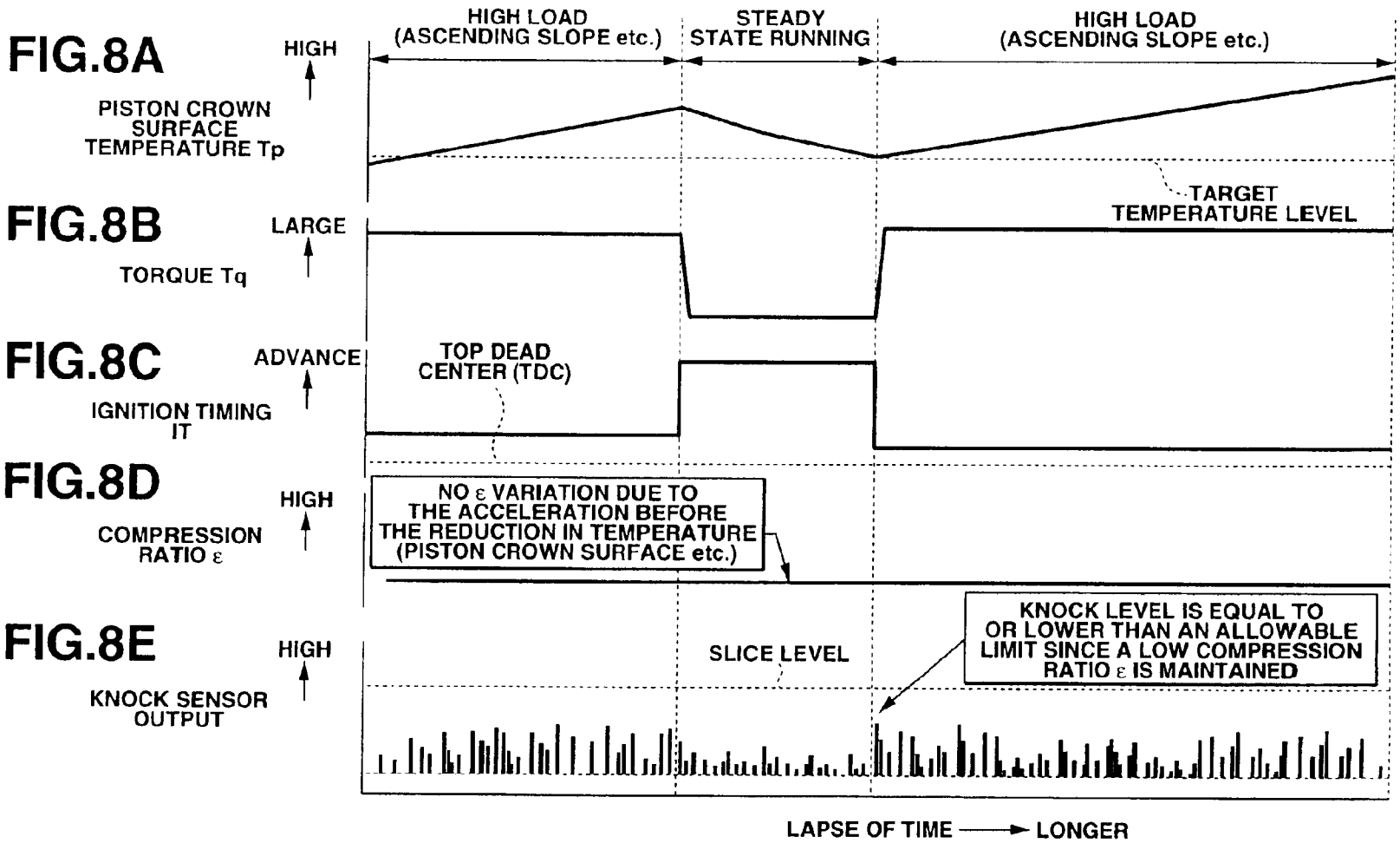
HIGH LOAD (ASCENDING SLOPE etc.)
STEADY STATE RUNNING
HIGH LOAD (ASCENDING SLOPE etc.)
TARGET TEMPERATURE LEVEL
TOP DEAD CENTER (TDC)
NO ε VARIATION DUE TO THE ACCELERATION BEFORE THE REDUCTION IN TEMPERATURE (PISTON CROWN SURFACE etc.)
SLICE LEVEL
KNOCK LEVEL IS EQUAL TO OR LOWER THAN AN ALLOWABLE LIMIT SINCE A LOW COMPRESSION RATIO ε IS MAINTAINED
LAPSE OF TIME → LONGER
FIG.8A
HIGH
PISTON CROWN SURFACE TEMPERATURE Tp
FIG.8B
LARGE
TORQUE Tq
FIG.8C
ADVANCE
IGNITION TIMING IT
FIG.8D
HIGH
COMPRESSION RATIO ε
FIG.8E
HIGH
KNOCK SENSOR OUTPUT

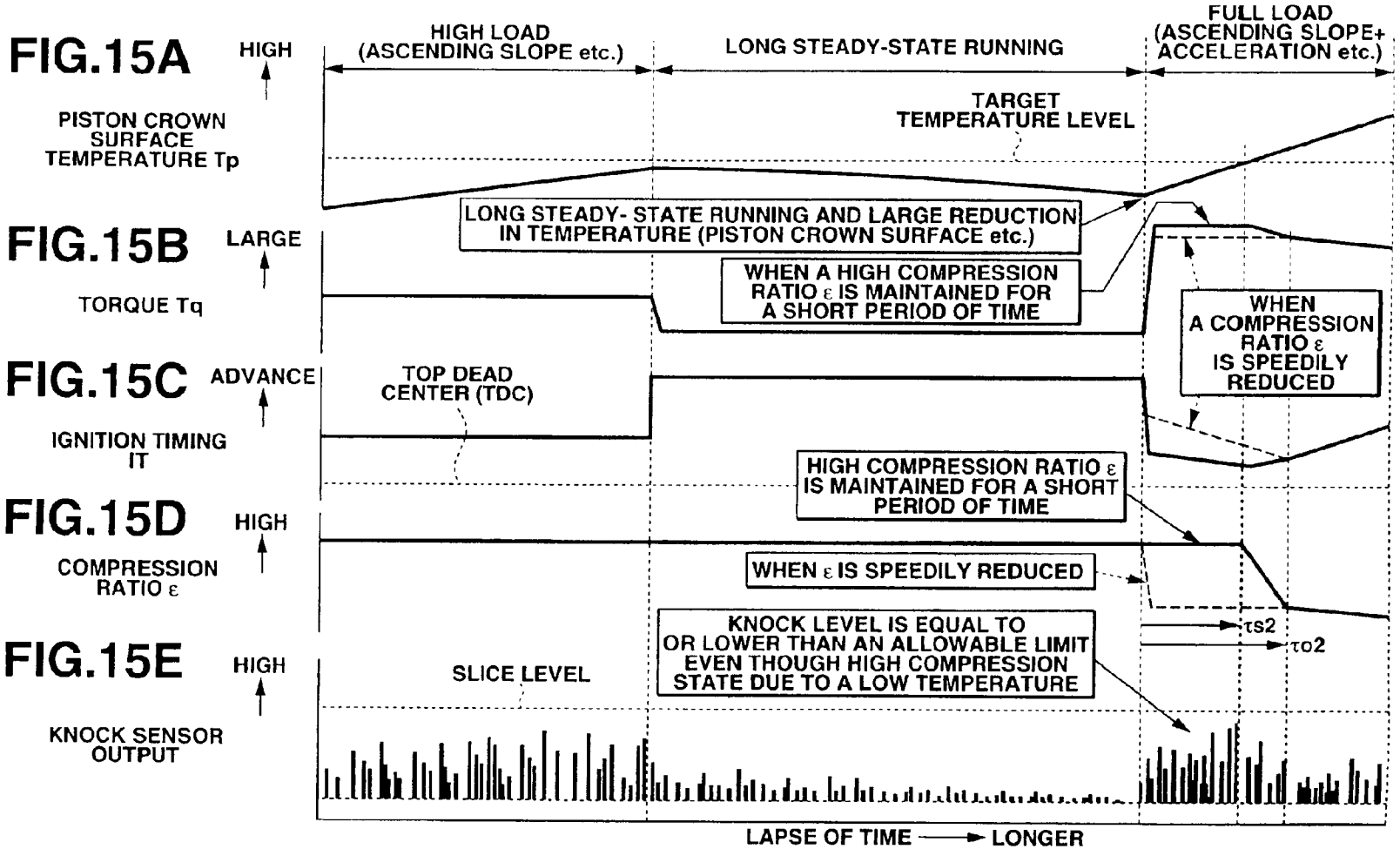
FULL LOAD (ASCENDING SLOPE+ ACCELERATION etc.)
LONG STEADY-STATE RUNNING
HIGH LOAD (ASCENDING SLOPE etc.)
TARGET TEMPERATURE LEVEL
LONG STEADY- STATE RUNNING AND LARGE REDUCTION IN TEMPERATURE (PISTON CROWN SURFACE etc.)
WHEN A HIGH COMPRESSION RATIO ε IS MAINTAINED FOR A SHORT PERIOD OF TIME
WHEN A COMPRESSION RATIO ε IS SPEEDILY REDUCED
TOP DEAD CENTER (TDC)
HIGH COMPRESSION RATIO ε IS MAINTAINED FOR A SHORT PERIOD OF TIME
WHEN ε IS SPEEDILY REDUCED
τs2
τo2
KNOCK LEVEL IS EQUAL TO OR LOWER THAN AN ALLOWABLE LIMIT EVEN THOUGH HIGH COMPRESSION STATE DUE TO A LOW TEMPERATURE
SLICE LEVEL
LAPSE OF TIME → LONGER
FIG.15A
HIGH
PISTON CROWN SURFACE TEMPERATURE Tp
FIG.15B
LARGE
TORQUE Tq
FIG.15C
ADVANCE
IGNITION TIMING IT
FIG.15D
HIGH
COMPRESSION RATIO ε
FIG.15E
HIGH
KNOCK SENSOR OUTPUT

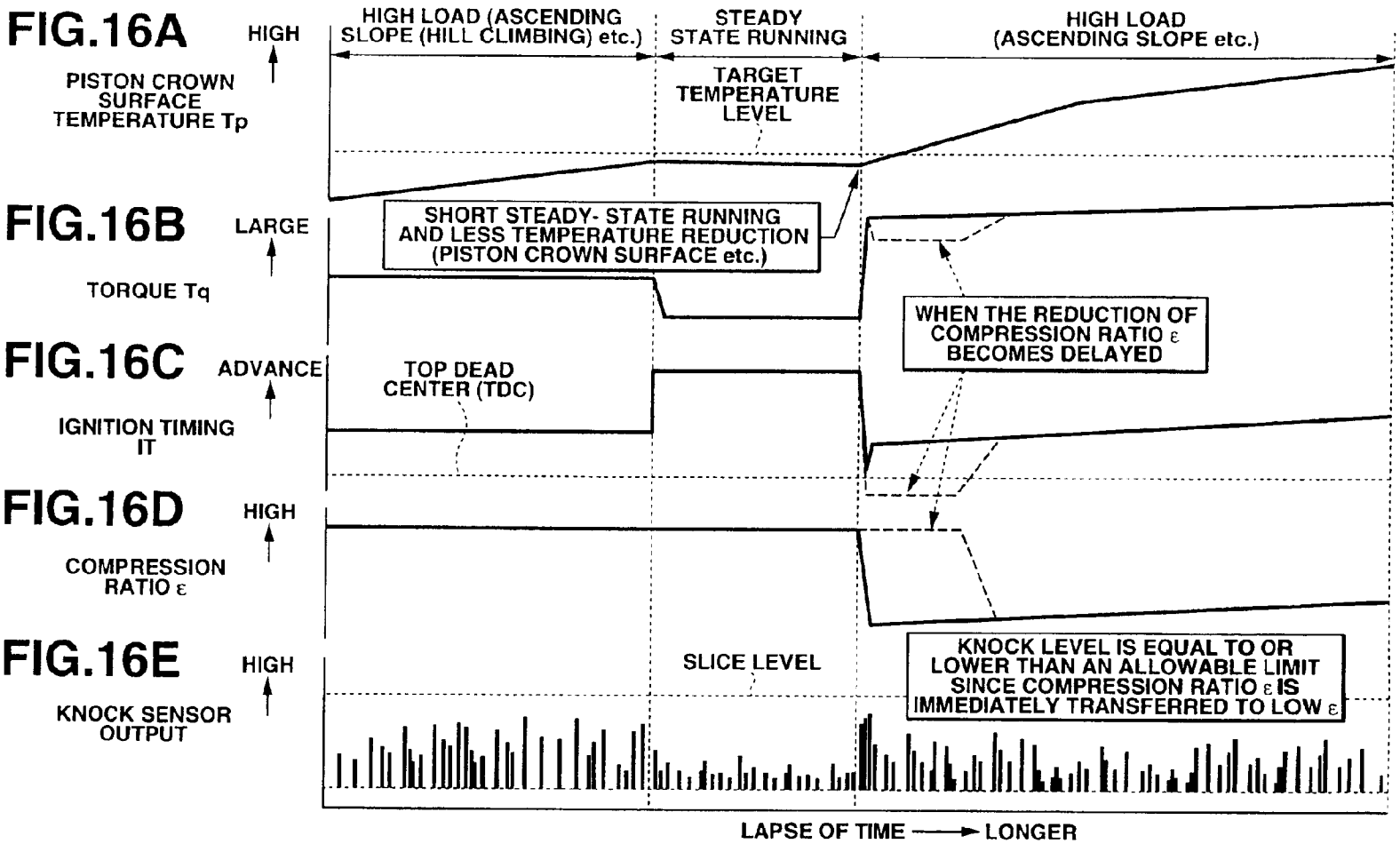
HIGH LOAD (ASCENDING SLOPE (HILL CLIMBING) etc.)
STEADY STATE RUNNING
HIGH LOAD (ASCENDING SLOPE etc.)
TARGET TEMPERATURE LEVEL
SHORT STEADY- STATE RUNNING AND LESS TEMPERATURE REDUCTION (PISTON CROWN SURFACE etc.)
WHEN THE REDUCTION OF COMPRESSION RATIO ε BECOMES DELAYED
TOP DEAD CENTER (TDC)
SLICE LEVEL
KNOCK LEVEL IS EQUAL TO OR LOWER THAN AN ALLOWABLE LIMIT SINCE COMPRESSION RATIO ε IS IMMEDIATELY TRANSFERRED TO LOW ε
LAPSE OF TIME → LONGER
FIG.16A
HIGH
PISTON CROWN SURFACE TEMPERATURE Tp
FIG.16B
LARGE
TORQUE Tq
FIG.16C
ADVANCE
IGNITION TIMING IT
FIG.16D
HIGH
COMPRESSION RATIO ε
FIG.16E
HIGH
KNOCK SENSOR OUTPUT

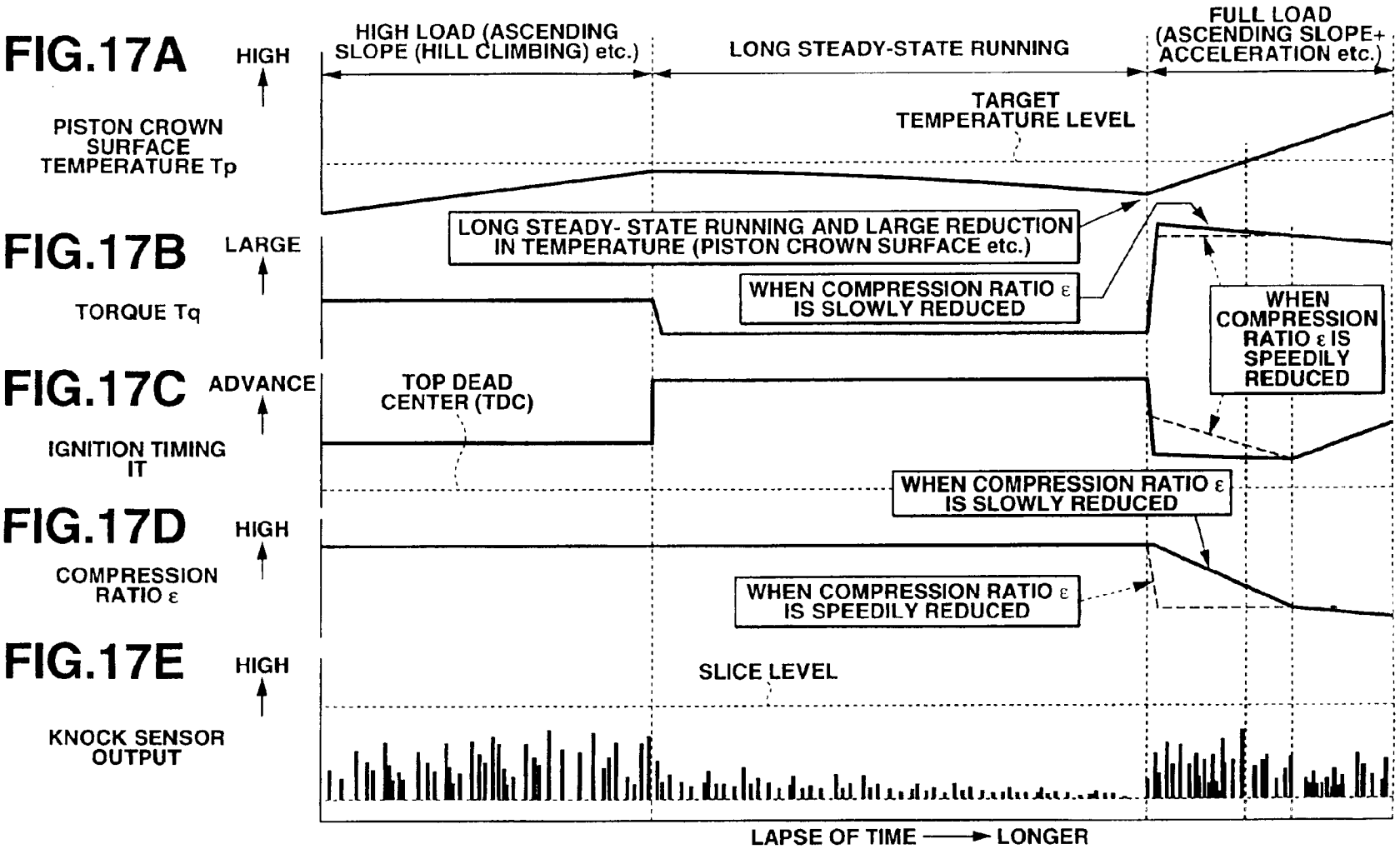
FULL LOAD (ASCENDING SLOPE+ ACCELERATION etc.)
LONG STEADY-STATE RUNNING
HIGH LOAD (ASCENDING SLOPE (HILL CLIMBING) etc.)
TARGET TEMPERATURE LEVEL
LONG STEADY- STATE RUNNING AND LARGE REDUCTION IN TEMPERATURE (PISTON CROWN SURFACE etc.)
WHEN COMPRESSION RATIO ε IS SLOWLY REDUCED
WHEN COMPRESSION RATIO ε IS SPEEDILY REDUCED
TOP DEAD CENTER (TDC)
WHEN COMPRESSION RATIO ε IS SLOWLY REDUCED
WHEN COMPRESSION RATIO ε IS SPEEDILY REDUCED
SLICE LEVEL
LAPSE OF TIME → LONGER
FIG.17A
HIGH
PISTON CROWN SURFACE TEMPERATURE Tp
FIG.17B
LARGE
TORQUE Tq
FIG.17C
ADVANCE
IGNITION TIMING IT
FIG.17D
HIGH
COMPRESSION RATIO ε
FIG.17E
HIGH
KNOCK SENSOR OUTPUT

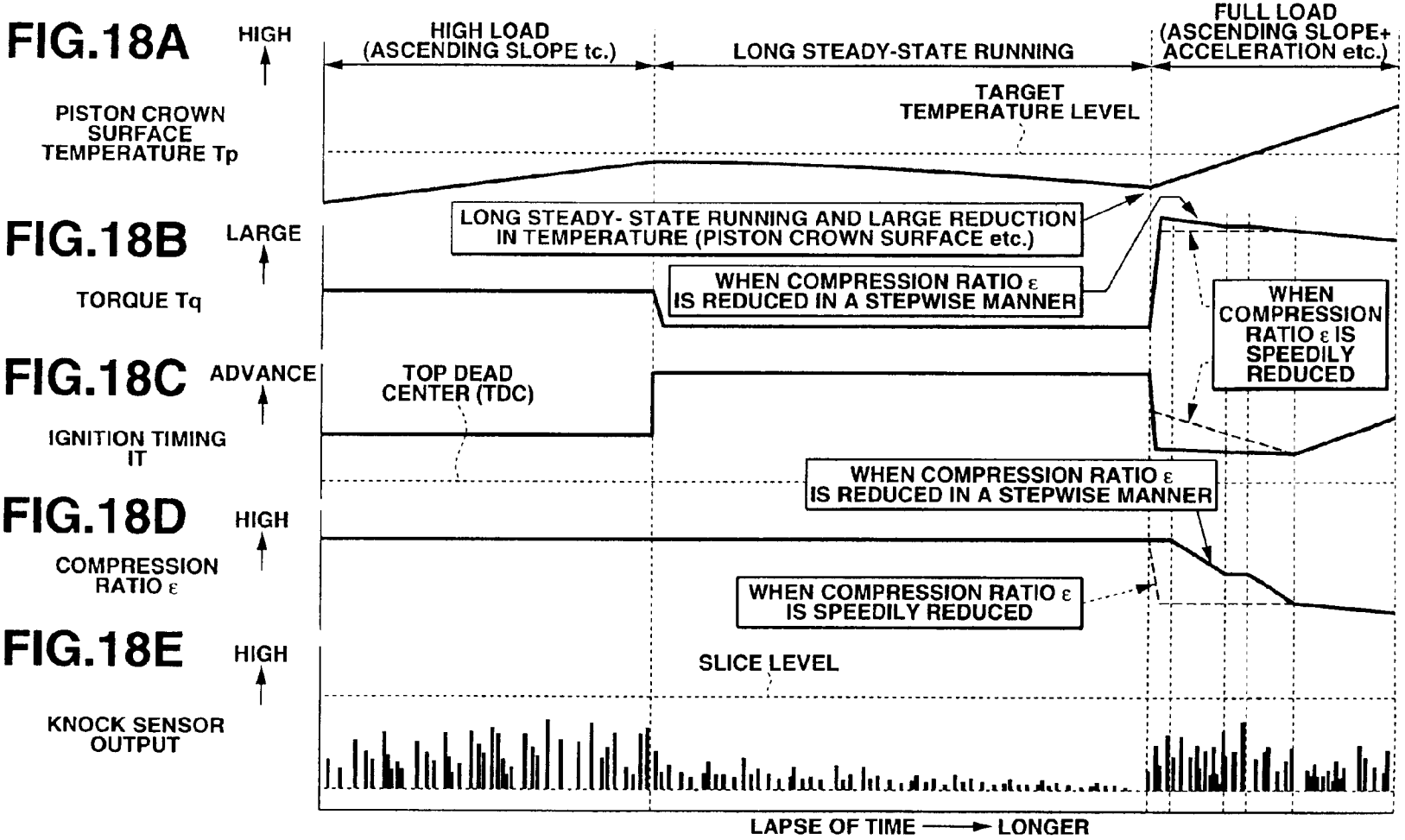
FULL LOAD (ASCENDING SLOPE+ ACCELERATION etc.)
LONG STEADY-STATE RUNNING
HIGH LOAD (ASCENDING SLOPE tc.)
TARGET TEMPERATURE LEVEL
LONG STEADY- STATE RUNNING AND LARGE REDUCTION IN TEMPERATURE (PISTON CROWN SURFACE etc.)
WHEN COMPRESSION RATIO ε IS REDUCED IN A STEPWISE MANNER
WHEN COMPRESSION RATIO ε IS SPEEDILY REDUCED
TOP DEAD CENTER (TDC)
WHEN COMPRESSION RATIO ε IS REDUCED IN A STEPWISE MANNER
WHEN COMPRESSION RATIO ε IS SPEEDILY REDUCED
SLICE LEVEL
LAPSE OF TIME → LONGER
FIG.18A
HIGH
PISTON CROWN SURFACE TEMPERATURE Tp
FIG.18B
LARGE
TORQUE Tq
FIG.18C
ADVANCE
IGNITION TIMING IT
FIG.18D
HIGH
COMPRESSION RATIO ε
FIG.18E
HIGH
KNOCK SENSOR OUTPUT

COMPRESSION RATIO CONTROLLING APPARATUS AND METHOD FOR SPARK-IGNITED INTERNAL COMBUSTION ENGINE

BACKGROUND OF THE INVENTION

1. Field of the Invention

The present invention relates to a compression ratio controlling apparatus and method for spark-ignited gasoline internal combustion engine in which a variable compression ratio mechanism is equipped.

2. Description of the Related Art

A Japanese Patent Application First Publication No. 2002-21592 published on Jan. 23, 2002 which corresponds to a U.S. Pat. No. 6,505,582 issued on Jan. 14, 2003 exemplifies a previously proposed multiple-link type piston-crank mechanism. The previously proposed multiple-link type piston-crank mechanism is a mechanism in which a piston upper top dead center (TDC) position is changed by moving a part of the link mechanism. Such a kind of variable compression ratio mechanism as described above is a mechanism to vary a mechanical compression ratio, in other words, to vary a nominal compression ratio of the internal combustion engine. In general, during a partial load of the engine, the compression ratio is controlled to be at a high compression ratio to improve a thermal efficiency and is controlled to be at a low compression ratio to avoid an occurrence of an engine knock during a high load of the engine.

SUMMARY OF THE INVENTION

In the variable compression ratio mechanism having a mechanically variable section as described above, if an abrupt (or sudden) acceleration (fast vehicular velocity change) occurs, the engine knock often occurs depending upon a certain condition when the compression ratio is switched from the high compression ratio to the low compression ratio. Easiness in developing the engine knock largely depends upon a wall temperature of a combustion chamber of the engine including a piston crown surface temperature. The wall temperature of the combustion chamber becomes higher under a higher load driving condition and becomes relatively low under a lower load driving condition. When the engine driving condition is transferred from a high engine load region to a low engine load region, the target compression ratio is changed from a predetermined low compression ratio to a predetermined high compression ratio. However, in a case where a re-acceleration is carried out with the drive under the low load region carried out for a short period of time, the engine load is transferred into the high load region which is easy to develop the knock before the wall temperature of the combustion chamber is sufficiently lowered. Hence, a response delay due to the change from the predetermined high compression ratio to the predetermined low compression ratio along with the re-acceleration causes the knock to become easy to transiently occur. In addition, since, in a generally known knock control, a retardation of an ignition timing on the basis of the detection of the engine knock is carried out, a temporary torque drop, that is to say, a torque hesitation occurs. On the other hand, when the compression ratio switches from the predetermined high compression ratio to the predetermined low compression ratio, the compression ratio is more abruptly lowered as described above than necessary, in order to avoid the occurrence of knock. At this time, on the contrary, a torque reduction corresponding to a reduction in a thermal efficiency occurs.

It is, hence, an object of the present invention to provide a compression ratio controlling apparatus and method for a spark-ignited internal combustion engine which can achieve a smoother power performance of the engine, while preventing occurrences of the engine knock and of the torque hesitation during a vehicular abrupt change in a vehicular velocity (for example, acceleration) driving.

According to a first aspect of the present invention, there is provided a compression ratio controlling apparatus for a spark-ignited internal combustion engine, comprising: a variable compression ratio mechanism that is enabled to operatively vary a compression ratio of the engine; a detecting section that detects an engine speed and an engine load; and a compression ratio controlling section that controls the variable compression ratio mechanism on the basis of the detected engine speed and engine load in such a manner that the compression ratio is varied toward a target high compression ratio when the engine load falls in a predetermined low load region and toward a target low compression ratio when the engine load falls in a predetermined high load region, the compression ratio controlling section providing a predetermined delay for a variation in the compression ratio toward one of the target high and low compression ratios at a time at which a transient state of the change in the engine load occurs in accordance with at least one of an engine driving history immediately before the transient state thereof occurs and a wall temperature of a combustion chamber of the engine immediately before the transient state thereof occurs.

According to a second aspect of the present invention, there is provided a compression ratio controlling apparatus for a spark-ignited internal combustion engine, comprising: a variable compression ratio mechanism that is enabled to operatively vary a compression ratio of the engine; a detecting section that detects an engine speed and an engine load; and a compression ratio controlling section that controls the variable compression ratio mechanism on the basis of the detected engine speed and engine load in such a manner that the compression ratio is varied toward a target high compression ratio when the engine load falls in a predetermined low load region and toward a target low compression ratio when the engine load falls in a predetermined high load region, the compression ratio controlling section controlling the variable compression ratio mechanism to vary the compression ratio toward one of the target high and low compression ratios in such a manner that the varied compression ratio reaches to the one of the target high and low compression ratios after a passage of a predetermined period of time from a time at which a transient state of a change in the engine load occurs.

According to a third aspect of the present invention, there is provided a compression ratio controlling method for a spark-ignited internal combustion engine, the engine comprising: a variable compression ratio mechanism that is enabled to vary a compression ratio of the engine, and the compression ratio controlling method comprising: detecting an engine speed and an engine load; controlling the variable compression ratio mechanism on the basis of the detected engine speed and engine load in such a manner that the compression ratio is varied toward a target high compression ratio when the engine load falls in a predetermined low load region and toward a target low compression ratio when the engine load falls in a predetermined high load region; and providing a predetermined delay in a variation in the compression ratio toward one of the target high and low compression ratios at a time at which a transient state of a change in the engine load occurs in accordance with at least one of an engine driving history immediately before the transient state thereof and a wall temperature of a combustion chamber of the engine immediately before the transient state thereof occurs.

This summary of the invention does not necessarily describe all necessary features so that the invention may also be a sub-combination of these described features.

BRIEF DESCRIPTION OF THE DRAWINGS

FIGS. 5A, 5B, 5C, 5D, and 5E are integrally a timing chart representing variation states in various parameters in a case of a comparative example of a compression ratio controlling apparatus with the compression controlling apparatus in the first embodiment when an engine load is changed in such a way as high load→low load→high load.

FIGS. 6A, 6B, 6C, 6D, and 6E are integrally a timing chart representing variation states in the various parameters in the case of the comparative example when a time duration for which the engine load is in a low load.

FIGS. 8A, 8B, 8C, 8D, and 8E are integrally a timing chart representing an example in which a time duration for which the engine load is relatively short in the case of the operation of the compression ratio controlling apparatus in the first embodiment.

FIGS. 15A, 15B, 15C, 15D, and 15E are integrally a timing chart of the variation states of the various parameters in a case of an operation of the compression ratio controlling apparatus in the comparative example with the second preferred embodiment when the engine load is changed in such a way as high load→low load→high load.

FIGS. 16A, 16B, 16C, 16D, and 16E are integrally a timing chart representing the variation states of the various parameters in cases of the operation of the compression ratio controlling apparatus in the comparative example with that in the second embodiment in which the time duration for which the engine load is low is relatively short.

FIGS. 17A, 17B, 17C, 17D, and 17E are integrally a timing chart of the variation states of the various parameters in the same way as shown in FIGS. 15A through 15E representing the operations in the cases of the comparative example and an alternative to the second embodiment in which the variation speed of the compression ratio is delayed.

FIGS. 18A, 18B, 18C, 18D, and 18E are integrally a timing chart of the variation states of the various parameters in the sane way as shown in FIGS. 15A through 15E representing an alternative to the second embodiment in which the compression ratio is varied in the stepwise manner.

DETAILED DESCRIPTION OF THE PREFERRED EMBODIMENTS

Reference will hereinafter be made to the drawings in order to facilitate a better understanding of the present invention.

Figure 1:
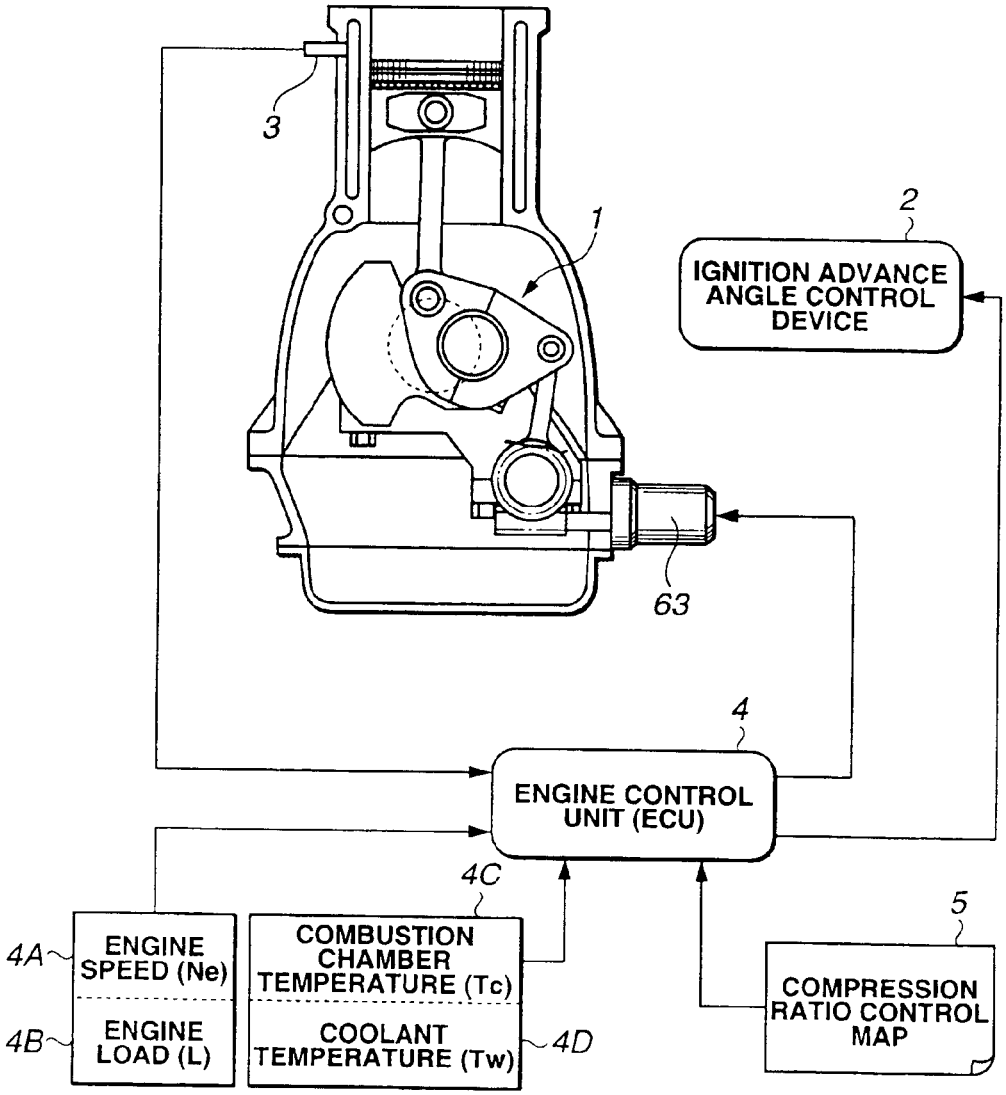
FIG. 1 is a whole schematic block diagram of a compression ratio controlling apparatus for a spark-ignited internal combustion engine in a first preferred embodiment according to the present invention.

FIG. 1 shows a first preferred embodiment of a compression ratio controlling apparatus for a spark-ignited internal combustion engine according to the present invention.

The internal combustion engine shown in FIG. 1 is a spark-ignited gasoline engine including: a variable compression ratio mechanism 1 which variably controls a nominal compression ratio $\epsilon$ (this variable compression mechanism has been described in the BACKGROUND OF THE INVENTION); an ignition advance angle controlling device 2 which controls an ignition advance angle with respect to an upper top dead center on the basis of a detection signal of a knock (or knock) sensor 3 which detects the engine knock when the knock level is in excess of a slice level so as to provide the engine with a minute knock state; and an engine control unit (ECU) which controllably adjusts compression ratio $\epsilon$ via variable compression ratio mechanism 1 and ignition timing IT via ignition advance angle controlling device 2. Engine control unit (ECU) 4 is provided with a compression ratio control map 5 to which target compression ratios are previously allocated so as to correspond to the engine driving condition. In addition, engine speed (Ne) indicative signal, engine load (L) indicative signal, coolant temperature (Tw) indicative signal and a combustion chamber temperature (Tc) signal detected by means of corresponding sensors 4A, 4B, 4C, and 4D and various sensors (not specifically shown) are inputted to ECU 4. ECU 4 includes a microcomputer having a CPU (Central Processing Unit), a RAM (Random Access Memory), a ROM (Read Only Memory), an Input Port, an Output Port, a common bus, and so forth.

Figure 2:
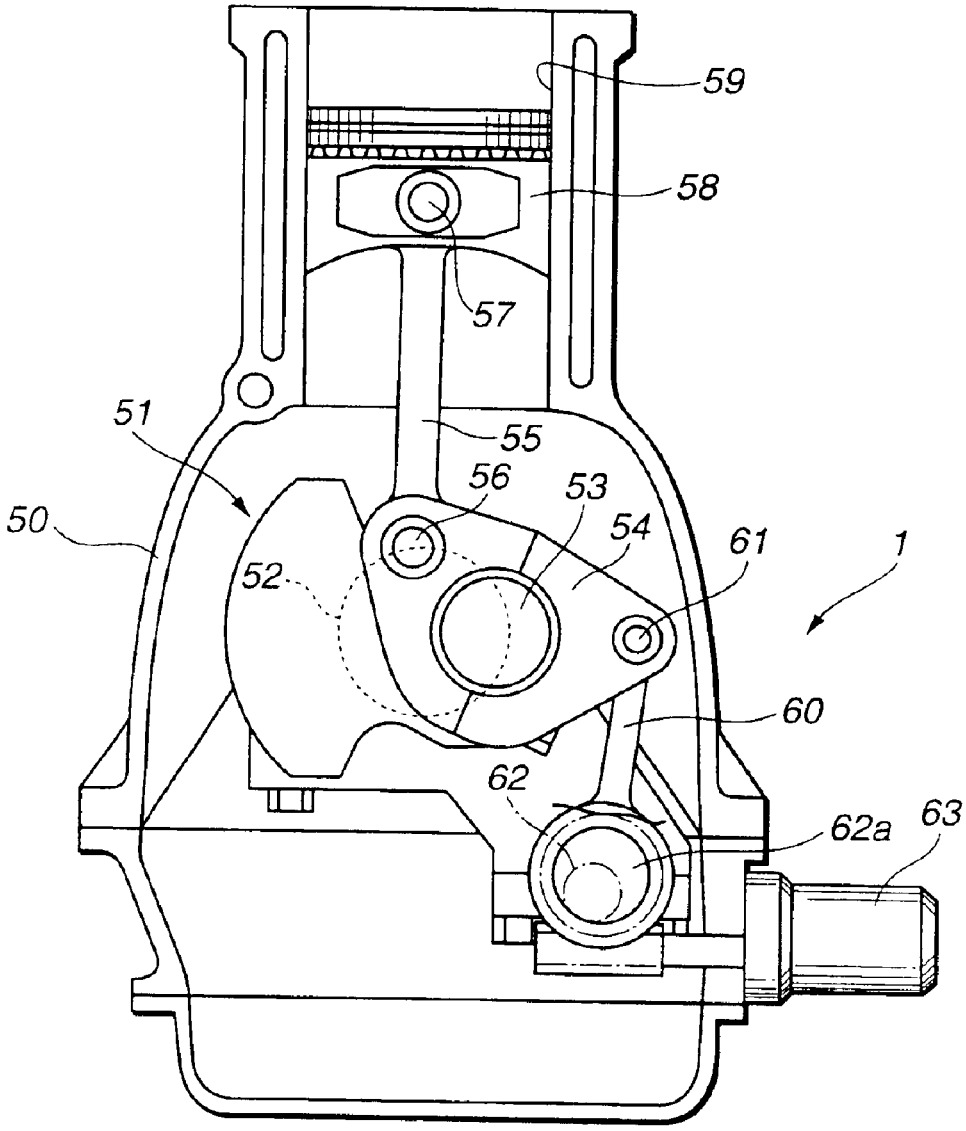
FIG. 2 is a partial cross sectioned elevation view of a variable compression ratio mechanism used in the compression ratio controlling apparatus in the first embodiment shown in FIG. 1.

FIG. 2 shows the variable compression ratio mechanism 1 shown in FIG. 1. An engine crankshaft 51 includes a plurality of journal portions 52 and a crank pin portion 53.

Each journal portion 52 is rotatably supported on a main bearing of a cylinder block 50. Crank pin portion 53 is by a predetermined quantity (predetermined distance) eccentric with respect to each journal portion 52. A lower link 54 which provides a second link is rotatably linked to crank pin 53. Lower link 54 is constituted by left and right two members and enabled to be divided into the two members and crank pin portion 53 is fitted into a communication hole located at a substantially center position of lower link 34.

An upper link 55 which provides a first link has a lower end linked pivotally to one end of lower link 54 by means of a linkage pin 56 and has an upper end pivotably linked to piston 58 by means of a piston pin 57. Piston 58 receives a combustion pressure and reciprocates within a cylinder 59 of cylinder block 50. It is noted that knock (or knock) sensor 3 is disposed on a part of cylinder block 50 to detect a vibration magnitude caused by the occurrence of engine knock, as shown in FIG. 1. A control link 60 which provides a third link has an upper end pivotably linked to the other end of lower link 54 via linkage pin 61 and has a lower end pivotably linked to a lower part of cylinder block 50 which provides part of engine main body via a control axle 62. In details, control axle 62 is rotatably supported on the engine main body and has eccentric cam portion 62*a* eccentric from a rotational center thereof. The lower end of control link 60 is rotatably fitted to eccentric cam portion 62*a*. A pivotal position of a control axle 62 is controlled by means of a compression ratio control actuator 63 using an electric motor on the basis of a control signal from engine control unit (ECU) 4 (refer to FIG. 1).

Figure 3B:
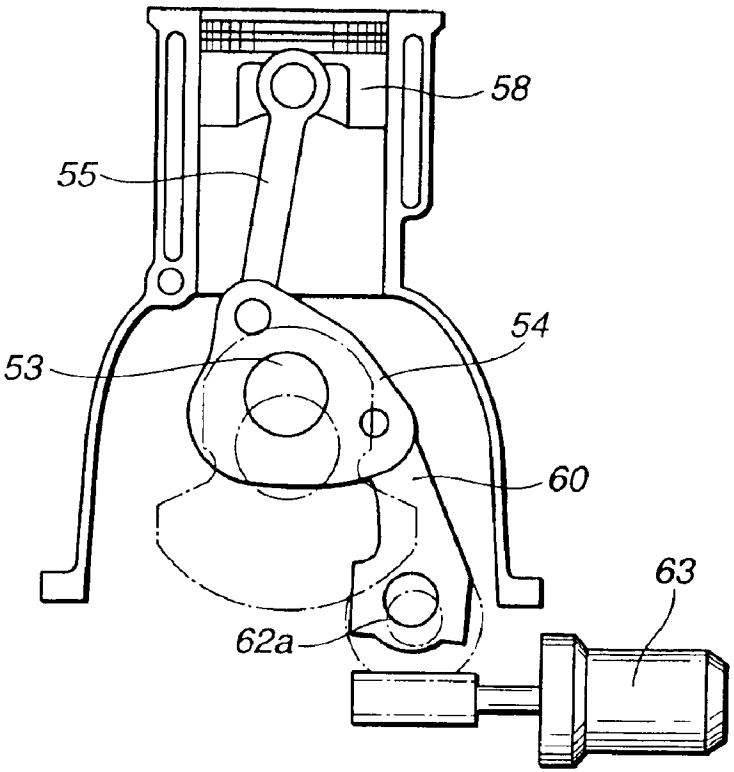
FIGS. 3A and 3B are explanatory views for explaining operations of the variable compression ratio mechanism shown in FIG. 2.
Figure 3A:
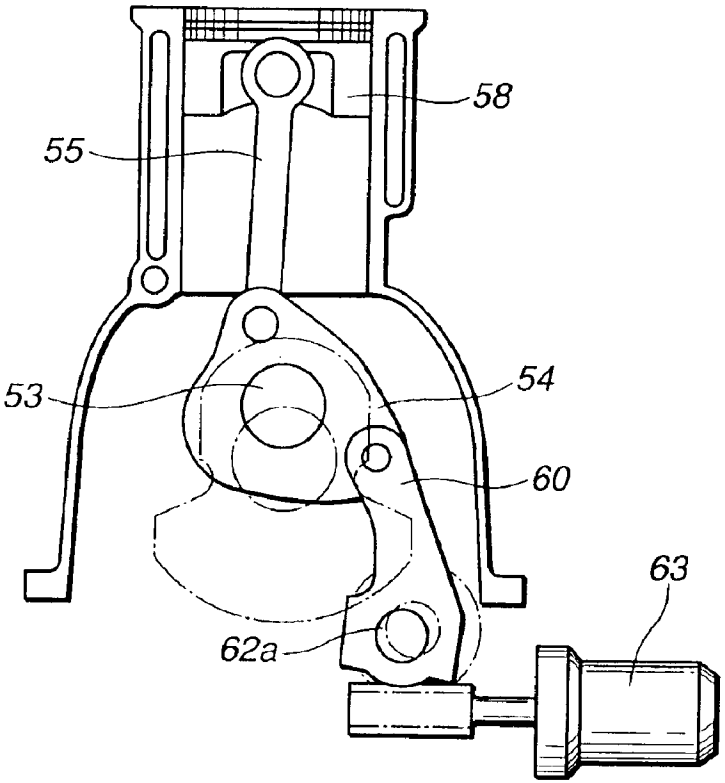
Figure 4:
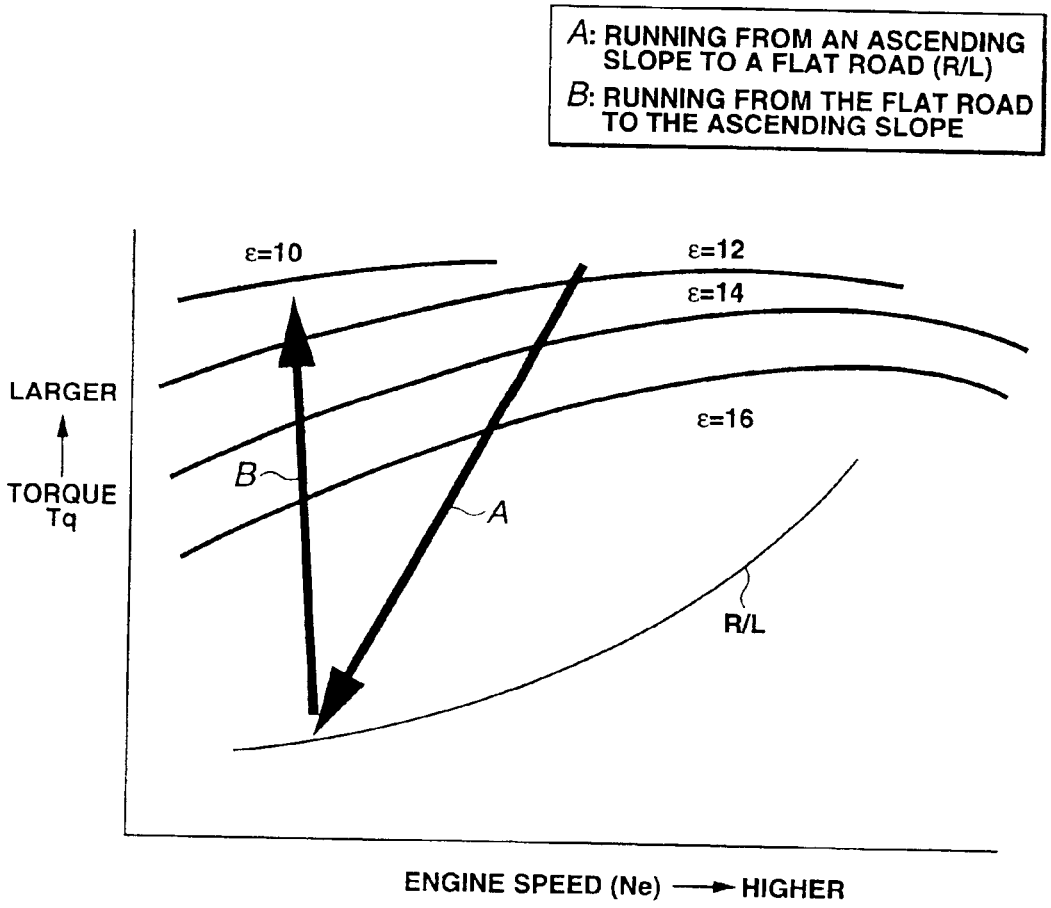
FIG. 4 is a characteristic graph representing compression ratio control characteristics according to a vehicular running situation the first embodiment of the compression ratio controlling apparatus.
Figures 7A, 7B, 7C, 7D, 7E:
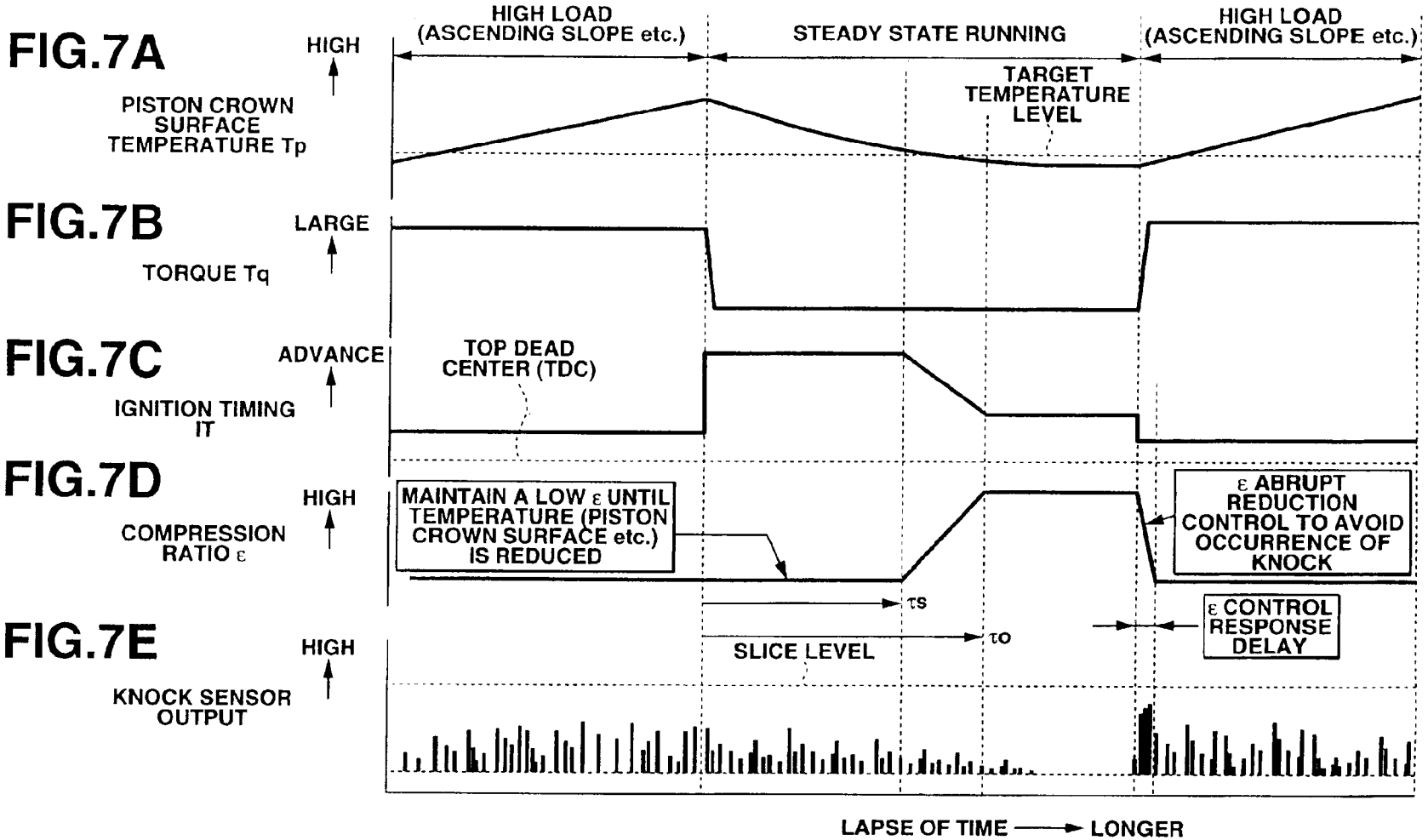
FIGS. 7A, 7B, 7C, 7D, and 7E are integrally a timing chart representing variation states in the various parameters in the case of an operation of the compression ratio controlling apparatus in the first embodiment according to the present invention when the engine load is changed in such a way as high load→low load→high load.

In variable compression ratio mechanism 1 using the multiple-link type piston-crank mechanism as described above, control axle 62 is pivoted by means of compression ratio control actuator 63. At this time, a center position of eccentric cam 62*a*, particularly, a relative position to the engine main body is changed. Thus, a swing supporting position of control link 60 at its lower end is changed. When the swing supporting position of control link 60 is changed, a stroke of piston 58 is changed so that a position of piston 58 at piston upper top dead center (TDC), as shown in FIGS. 3A and 3B, is changed between an uppermost position and a lowest position. Thus, it becomes possible to change the engine compression ratio. FIGS. 3A and 3B show representatively a (predetermined) high compression ratio state and a (predetermined) low compression ratio state. However, it is possible to change the compression ratio continuously between the predetermined high compression state and low compression state. FIG. 4 shows control characteristics of each compression ratio, in other words, characteristics of target compression ratios set on compression ratio control map 5 according to the engine driving condition (torque and engine speed). It is noted that this compression ratio is a geometric compression ratio $\epsilon$ determined only by a volume variation in the combustion chamber due to the stroke of piston 58.

In a case where a full load region with a low engine speed is a condition under which the knock easily occurs, the target compression ratio is, in this case, 12. It is of course that when a coolant temperature Tw is remarkably high so that an overheat tends to occur, the target compression ratio is needed to be low (for example, 10). On the other hand, since, under a partial load region (for example, the vehicle is running on a flat road (R/L, viz., road load)), the knock is not easy to occur, the target compression ratio is set to be as high as approximately 16 in order to improve a fuel economy. Since the knock becomes difficult to occur under the full load region with high engine speed, the target compression ratio is set to be relatively high in order to improve an engine output due to the improvement in the thermal efficiency.

Next, an operation of the first embodiment of the compression ratio controlling apparatus will be described below. In the first embodiment, in a case where the vehicle is transferred after the run on an ascending slope (hill climbing) into the flat road run and, thereafter, again transferred into the run on another ascending slope (for example, in a case where the drive condition is varied as shown by arrow marks A and B in FIG. 4), a different control from a comparative example in which the compression ratio is merely controlled in accordance with the driving condition is carried out, in the first embodiment.

First, in order to facilitate a better understanding of the present invention, the comparative example in which the compression ratio is merely controlled in accordance with the engine driving condition will be described with reference to a timing chart in FIGS. 5A through 5E.

FIGS. 5A through 5E show transient variations in respective characteristic values along with a time lapse in a case where the engine driving condition of the vehicle is varied from a high engine load condition, via a low engine load condition, again to the high engine load condition (high-load driving→low-load driving→high-load driving).

When it has passed a long time during a first run on the ascending slope, a temperature surrounding the combustion chamber such as that Tp of a piston crown surface is remarkably raised (refer to FIG. 5A) and intake air-fuel mixture is heated with a rise in temperature of the combustion chamber. Hence, the engine driving condition falls in a condition such that the knock easily occurs. Under such a high load condition as described above, target compression ratio $\epsilon s$ of compression ratio $\epsilon$ is set to be low. Hence, the knock is not found. In a case where the vehicle running mode is transferred from this condition to a flat road run and the engine load indicates R/L (Road Load), target compression ratio $\epsilon s$ corresponding to this condition is remarkably high (for example, 16) as described above, actuator 63 of variable compression ratio mechanism 1 is operated and compression ratio $\epsilon$ is transferred to target compression ratio $\epsilon s$. It is noted that ignition timing IT is changed as shown in FIG. 5C along with a decrease in load and a change in compression ratio $\epsilon$.

Immediately after the vehicle driving state is transferred into the flat road run, the wall temperature of the combustion chamber (for example, the piston crown surface temperature Tp) is still high but the engine load condition is low. Hence, although the combustion chamber wall temperature is high, no engine knock is found. It is noted that FIG. 5E shows an output of knock sensor 3 and, if the output thereof is in excess of a predetermined slice level (or threshold value), ECU 4 determines that the knock has occurred and ignition timing IT is corrected in a retardation angle side. In the example of FIGS. 5A through 5E, after a state of the flat road run is maintained for a while, the vehicle runs on the other ascending slope (hill climbing), in other words, the vehicle driving condition becomes the high-load drive. Together with the transfer of the high load drive, compression ratio $\epsilon$ is changed from the target high compression ratio to the target low compression ratio. At this time, if a more or less control delay is generally present in the variable compression ratio mechanism 1, compression ratio $\epsilon$ is not instantaneously reduced. Hence, since the engine driving condition is transferred into the high load region with the high compression ratio maintained. However, in the example of FIGS. 5A through 5E, the engine driving condition continues with the low load drive for a sufficiently long interval of time. In this case, since the combustion chamber wall temperature (piston crown surface temperature Tp) is sufficiently lowered, the knock level, at the present time, can fall within an allowance limit.

However, as shown in FIGS. 6A through 6E, if a time it passes until the vehicle runs on the other ascending slope is short, in other words, a time interval during which the engine low-load driving condition is continued is short, the engine driving condition is transiently transferred into the high load driving condition (with the high compression ratio maintained and) without a sufficient reduction of the combustion chamber wall temperature (piston crown surface temperature Tp). Hence, due to a response delay in variable compression ratio mechanism 1, the engine driving condition is the high-load driving with the high compression ratio maintained at a transitional period and the knock occurs. Then, along with the detection of this knock (refer to FIG. 6E), the ignition timing IT is remarkably retarded. Hence, the engine output is remarkably reduced. An engine driveability during the transitional period becomes inferior (deteriorated) due to the torque hesitation, in such a form as a torque variation.

Whereas, in the first embodiment, during the transitional period of a state transition from the high load region to the low load region, compression ratio $\epsilon$ is not abruptly varied but reaches to target compression ratio after a predetermined period of time $\tau_0$ has passed from a time at which the engine load condition is changed from the high load region to the low load region.

FIGS. 7A through 7E show transient variations of the respective characteristic values according to the control of compression ratio $\epsilon$ executed in the first preferred embodiment of compression ratio controlling apparatus and indicates the same running situation as that shown in FIGS. 5A and 5E.

In this example of FIGS. 7A through 7E, a predetermined delay $\tau s$ is provided and the compression ratio control is started from a time point at which predetermined period of delay time $\tau s$ has passed to be directed toward the target compression ratio, in other words, toward the high compression ratio. Thus, upon an end of a lapse of a predetermined period of time $\tau_0$, an actual compression ratio $\epsilon$ is reached to target compression ratio $\epsilon s$. During the passage of predetermined period of time $\tau_0$, the combustion chamber wall temperature (piston crown surface temperature Tp) is sufficiently reduced. Hence, no knock occurs during the start of the run on the other (subsequent) ascending slope.

FIGS. 8A through 8E show a case where a time for which the vehicle runs on the flat road to a start of the vehicular run on the other (subsequent) ascending slope is relatively short in the same situation as shown in FIGS. 6A through 6E.

Especially, in the example shown in FIGS. 8A through 8E, a time interval during which the vehicle runs on the flat road is shorter than delay time $\tau s$ described above with reference to FIGS. 7A through 7E. Hence, at a stage of time at which the control of compression ratio $\epsilon$ toward target high compression ratio $\epsilon s$ is not yet started after the engine load driving is transferred from the high-load drive to the low-load drive, the engine driving condition indicates again the high-load drive. Since actual compression ratio $\epsilon$ does not yet indicate the high compression ratio at a time point at which the engine load indicates the high load region, there is no possibility that the knock occurs.

As described above, after the engine is transferred into the low load region, actual compression ratio $\epsilon$ is controlled to provide the high compression ratio with a time margin until the combustion chamber wall temperature (piston crown surface temperature Tp) is reduced after the engine load region is transferred into the low-load region. At this time, the occurrence of knock along with the delay in the compression ratio control during an re-acceleration can be avoided without failure.

The above-described predetermined period of time $\tau_0$ or a value required for delay time $\tau s$ is dependent upon the combustion chamber wall temperature (piston crown surface temperature Tp). As the combustion chamber wall temperature (piston crown surface temperature Tp) becomes higher, it is necessary to provide a longer predetermined period of time $\tau_0$ and/or delay time $\tau s$. Hence, it is desirable for a temperature sensor constituted by, for example, a thermocouple to be disposed in the vicinity to the combustion chamber of the cylinder head to directly detect a wall temperature of the combustion chamber, and delay time $\tau s$ may variably be set in accordance with the directly measured wall temperature of the combustion chamber. In addition, the temperature state may directly be set in accordance with an immediate-before drive history immediately before the transfer of the load condition to the low-load region without a direct detection of the combustion chamber.

Figure 9:
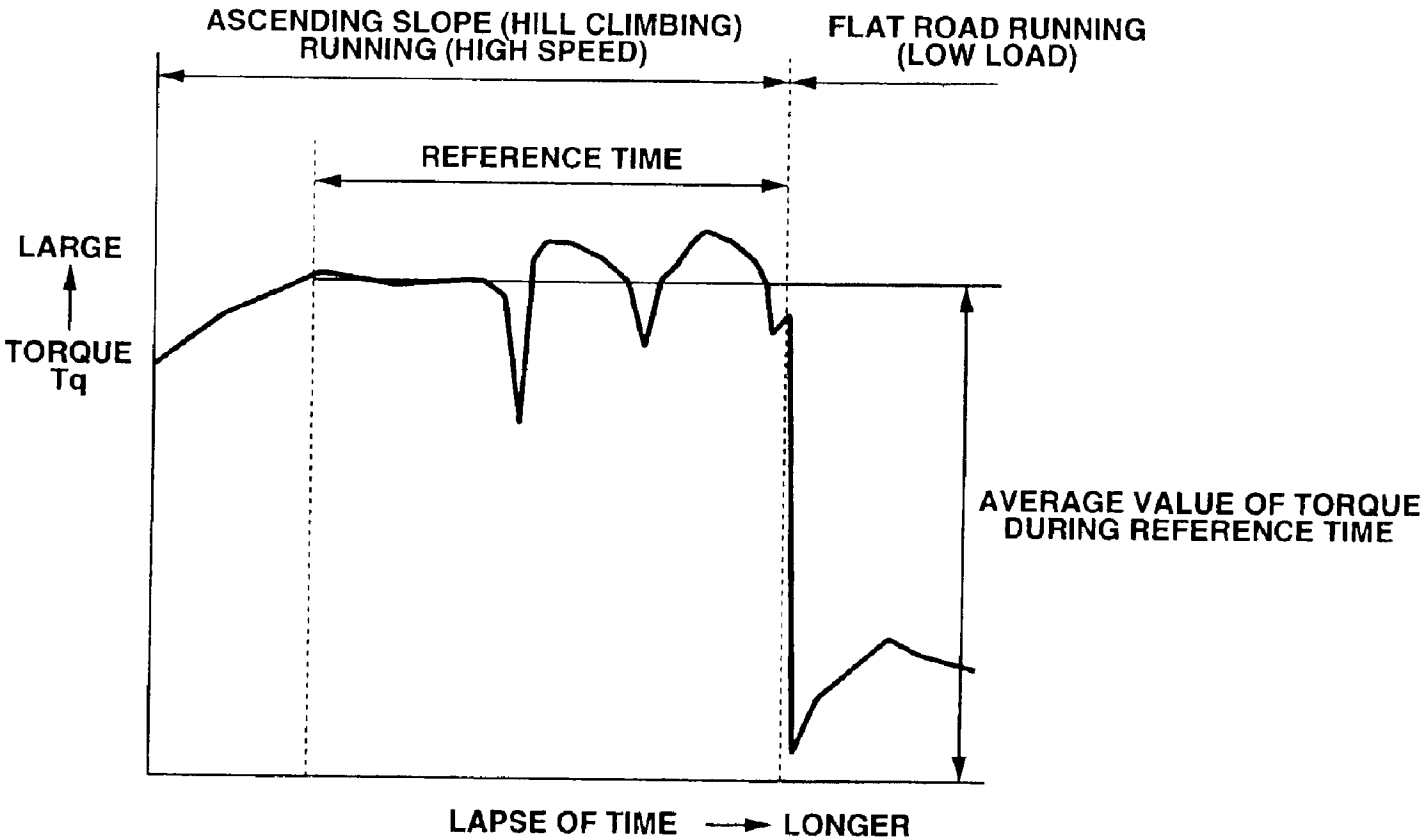
FIG. 9 is an explanatory view for explaining an average load percentage (rate) Pm in the case of the first embodiment of the compression ratio controlling apparatus.
Figures 10A, 10B, 10C, 10D, 10E:
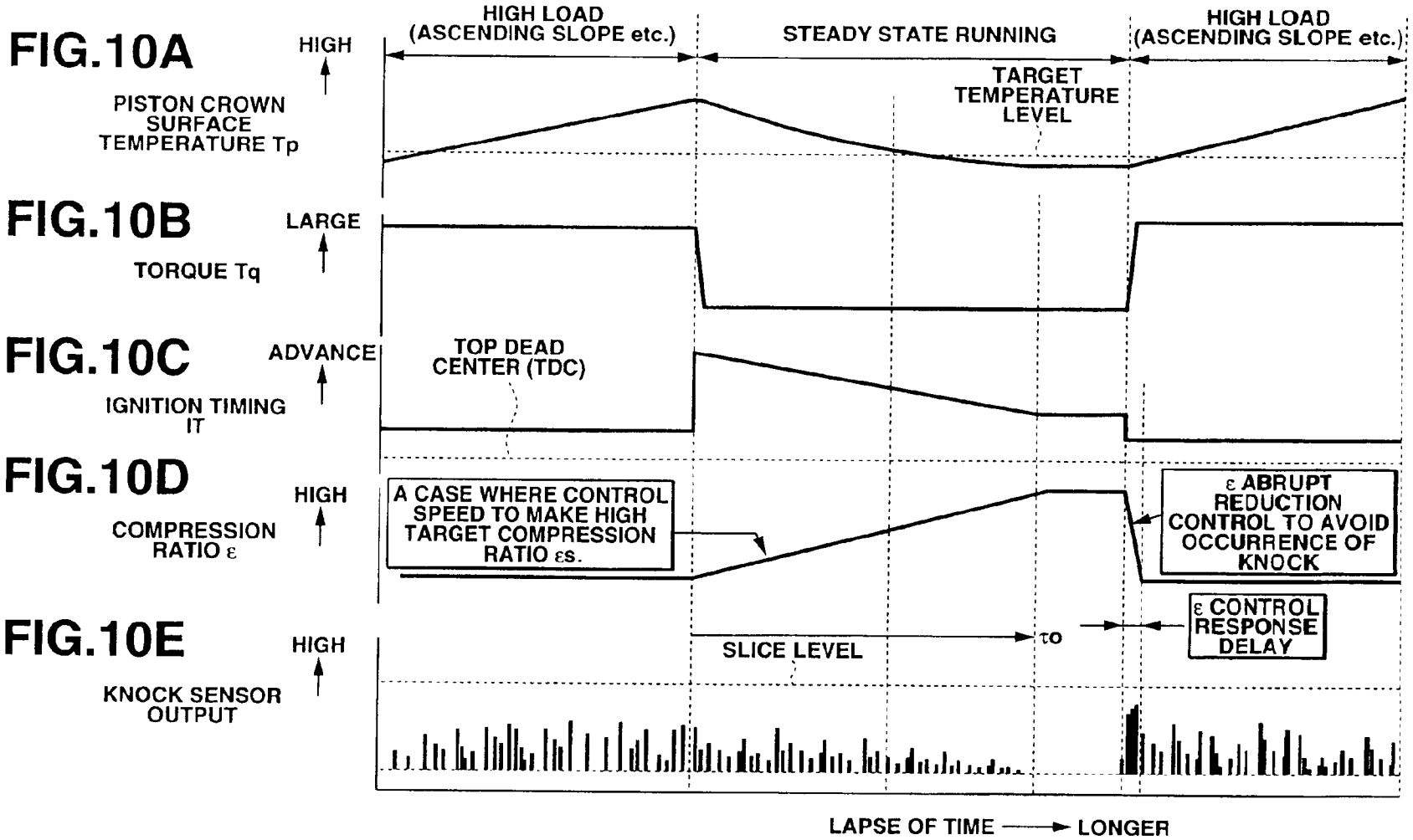
FIGS. 10A, 10B, 10C, 10D, and 10E are integrally a timing chart representing variation states in the various parameters in the same way as shown in FIGS. 7A through 7E in the case of an alternative to the first embodiment in which a variation speed of the compression ratio is delayed.
Figures 11A, 11B, 11C, 11D, 11E:
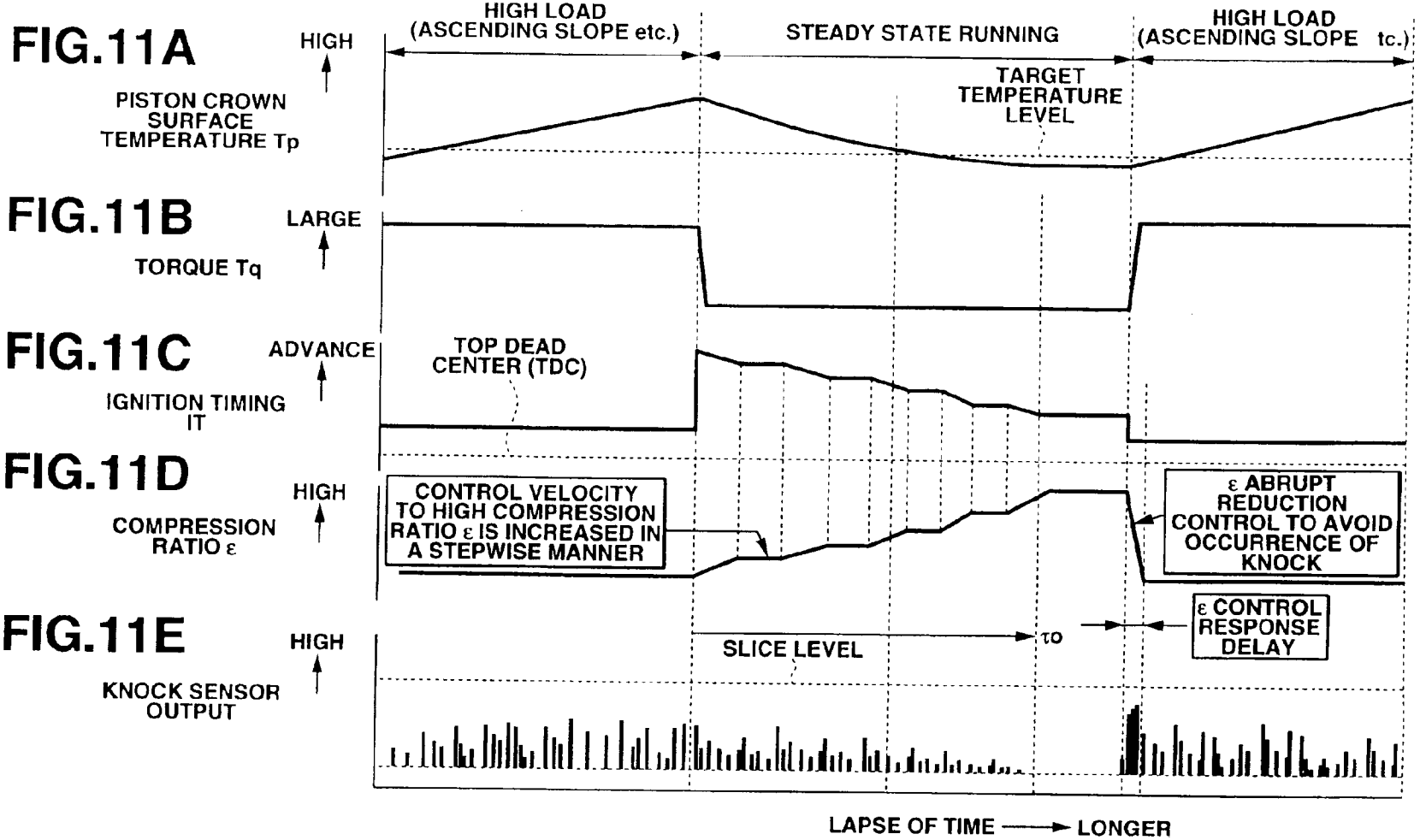
FIGS. 11A, 11B, 11C, 11D, and 11E are integrally a timing chart representing variation states of the various parameters in the same way as shown in FIGS. 7A through 7E in the case of another alternative to the first embodiment in which the compression ratio is varied in a stepwise manner.
Figures 12A, 12B, 12C, 12D:
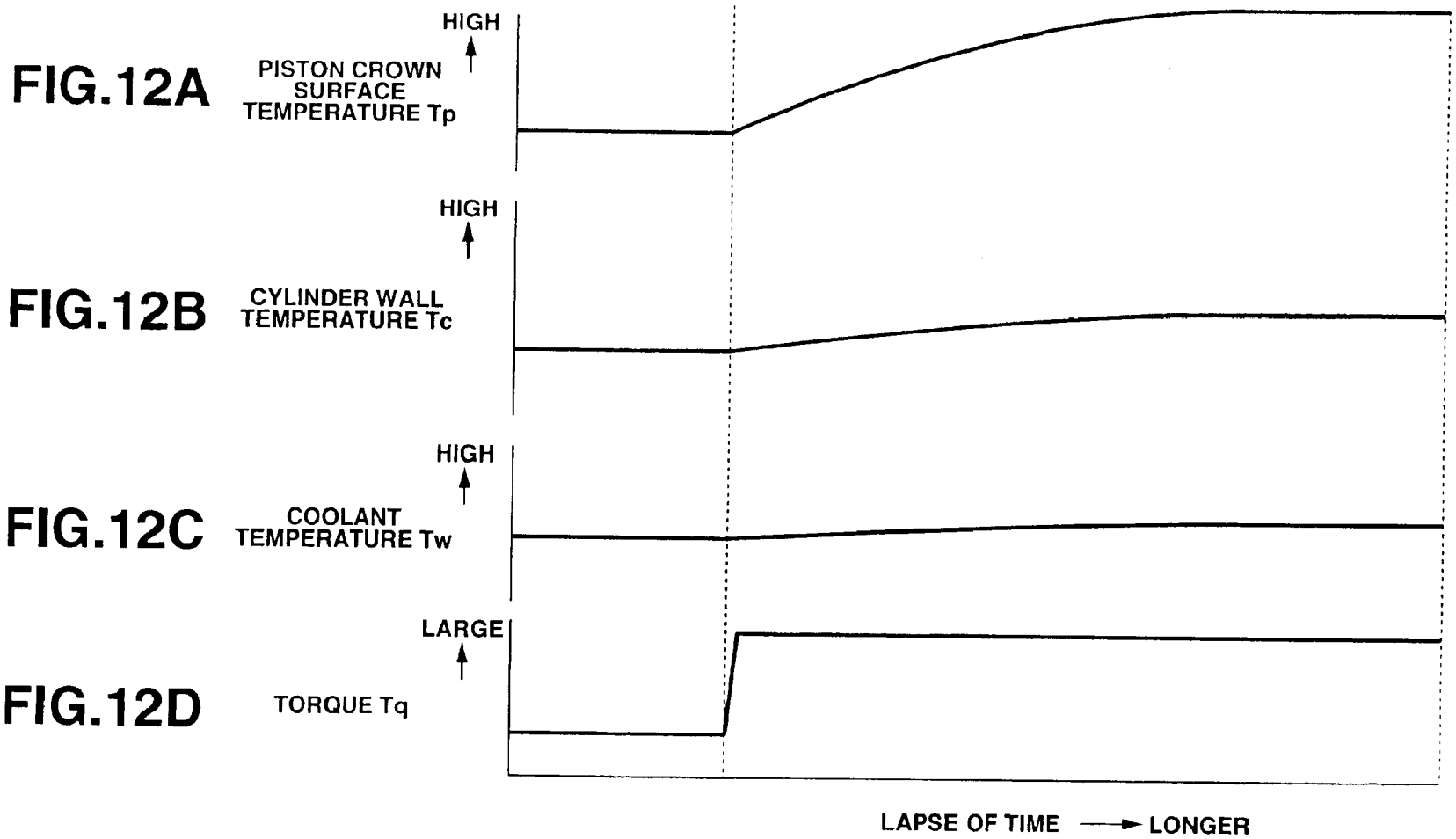
FIGS. 12A, 12B, 12C, and 12D are characteristic graphs representing characteristics of temperature rises of respective portions of the engine when a vehicle runs on an ascending slope (hill climbing).

FIG. 9 shows one example of the drive history immediately before the engine load state is transferred into the low load region. ECU 4 determines an average value of a torque (or the load) for a predetermined period of time (an interval of time and also referred to as a reference time) immediately before the transfer of the vehicular run into the flat road run (low load drive) as an average load percentage Pm and may determine a parameter representing a temperature state of the wall of the combustion chamber. Otherwise, an average load condition may be detected by an appropriate method to estimate the temperature state thereof.

Figure 13:
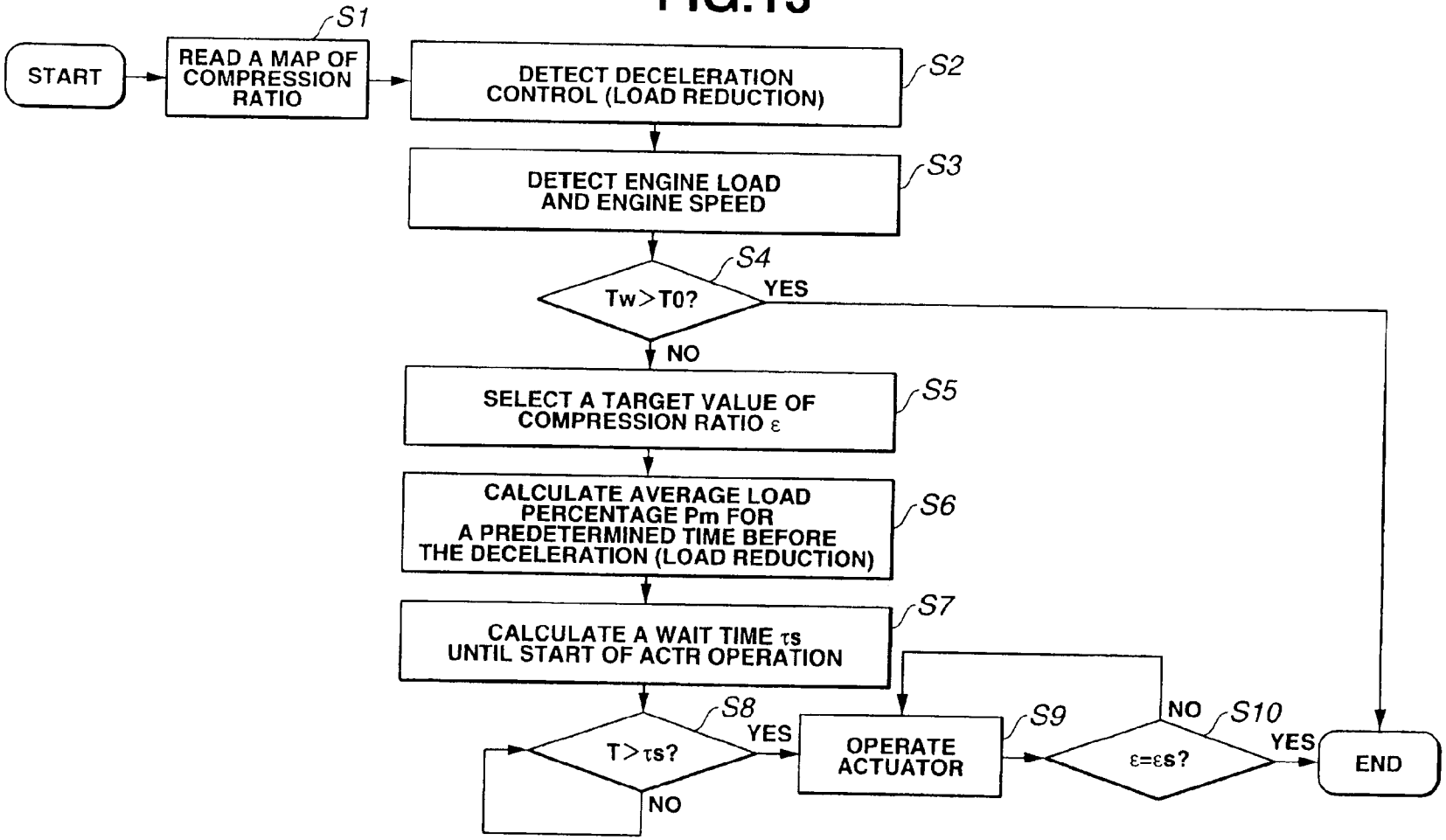
FIG. 13 is an operational flowchart representing a procedure of a compression ratio control in which a delay time is provided during a vehicular deceleration in the case of the first embodiment.

FIG. 13 shows an example of a specific flowchart representing the compression ratio control executed in ECU 4 in the first embodiment. It is noted that the flowchart shown in FIG. 13 is a procedure of the compression ratio control when the engine driving condition is transferred from the high load region to the low load region.

At a step S1, ECU 4 reads compression ratio $\epsilon$ map 5 shown in FIG. 1 according to the engine speed and engine load (torque). At a step S2, ECU 4 determines whether the engine driving condition falls in an engine deceleration condition (load reduction state). It is noted that the determination at step S2 is executed in a subroutine (not shown) by a detection of a variation in an opening angle of an accelerator pedal. If the engine driving condition at step S2, ECU 4 detects the engine load (L) and engine speed (N) at a step S3. At a step S4, ECU 4 determines if coolant temperature Tw is in excess of a predetermined temperature T0. If Tw>T0 (Yes) at step S4, ECU 4 determines that the engine overheat state will occur and the routine of FIG. 13 is ended. On the other hand, if Tw≦T0 (No) at step S4, the routine goes to a step S5 to select a target value $\epsilon s$ of compression ratio $\epsilon$ according to the engine driving condition (engine speed and engine load (or torque Tq). Next, ECU 4 calculates an average load percentage Pm for a predetermined period of time before the start of the deceleration at a step S6. At a step S7, ECU 4 derives delay time (wait time) TS until the start of operation of actuator 63. At a step S8, ECU 4 determines if a lapse time point T from the start of the deceleration is in excess of delay time $\tau s$. If T>$\tau s$ at step S8 (Yes), actuator 63 is started operation at a step S9. At a step S10, ECU 4 determines whether the instantaneous compression ratio $\epsilon$ indicates target compression ratio $\tau s$, a variation speed from the predetermined low compression ratio to the predetermined high compression ratio reaches to target compression ratio $\epsilon S$. Until $\epsilon$= or ≈$\epsilon S$, steps S9 and S10 are repeated to continue to the drive (operation) of actuator 63.

Next, FIGS. 10A through 10E shows an example of a result of an alternative of the compression ratio control in the first embodiment in the same situation as shown in FIGS. 7A through 7E. In this alternative, in place of providing delay time $\tau s$, a variation speed from the predetermined (target) low compression ratio to the predetermined high (target) compression ratio along with the transfer of the engine load from high load region to the low load region, in other words, a control speed of actuator 63 is positively slowed so that the compression ratio reaches to target compression ratio $\epsilon s$ after predetermined period of time $\tau_0$ has passed. It is desirable that the control speed, at this time, may variably be set in accordance with the detected or estimated combustion chamber wall temperature.

FIGS. 11A through 11E integrally show various characteristics of the engine driving parameters to describe another alternative of the first embodiment of the compression ratio control apparatus in which the change of the compression ratio from the predetermined low compression ratio to the predetermined high compression ratio along with the transfer of the engine load from the high load region to the low load region is carried out in a stepwise manner. That is to say, in this embodiment, one or a plurality of intermediate target compression ratios between the low target compression ratio before the transfer to the low load region and the high target compression ratio after the transfer to the low load region may be set so that compression ratio $\epsilon$ is changed in the stepwise manner for each step of the intermediate target compression ratios toward the predetermined high compression ratio. In other words, actuator 63 is intermittently driven. The intermediate target compression ratios may fixedly be preset or may be calculated from the target compression ratio before the transfer of the engine driving condition thereto and from the target compression ratio after the transfer of the engine driving condition thereto.

FIGS. 12A through 12D shows a temperature rise characteristic of each part of engine, i.e., piston crown temperature Tp, cylinder wall temperature Tc, coolant temperature Tw, and a torque variation when the vehicle runs on an ascending slope (hill climbing) which is a representative example of a high load drive. If the high load drive is continued, the temperature of each part described above is basically raised. However, a rise width of piston crown surface temperature Tp is large as compared the cylinder wall temperature which receives influences largely from the coolant. Coolant temperature Tw is controlled to become approximately constant through a thermostat. If the high load state is continued, coolant temperature Tw is more or less raised. Even when it approaches to a limit of a capacity of an engine coolant system, the coolant temperature is, furthermore, raised so that the engine falls in the overheat state. However, FIGS. 12A through 12D do not show the overheat state.

Since coolant temperature Tw is generally detected by means of a temperature sensor, this coolant temperature Tw is used and delay time $\tau s$ and control variation velocity (control speed) may be set on the basis of the degree of coolant temperature Tw. In details, as coolant temperature Tw becomes higher, predetermined period of time $\tau_0$ it takes for compression ratio $\epsilon$ to reach to high target compression ratio may be elongated. In addition, since, as coolant temperature Tw is raised, the temperature of a cylinder block and a cylinder head through which the coolant is circulated is raised. The temperatures of these portions of the cylinder head and cylinder block may be detected.

Next, the compression ratio control during a vehicular acceleration in a second preferred embodiment of the compression ratio controlling apparatus according to the present invention be described below with reference to FIGS. 14 through 20. The structure of the compression ratio controlling apparatus is generally the same as described in the first embodiment. The detailed description thereof will be omitted herein.

Figure 14:
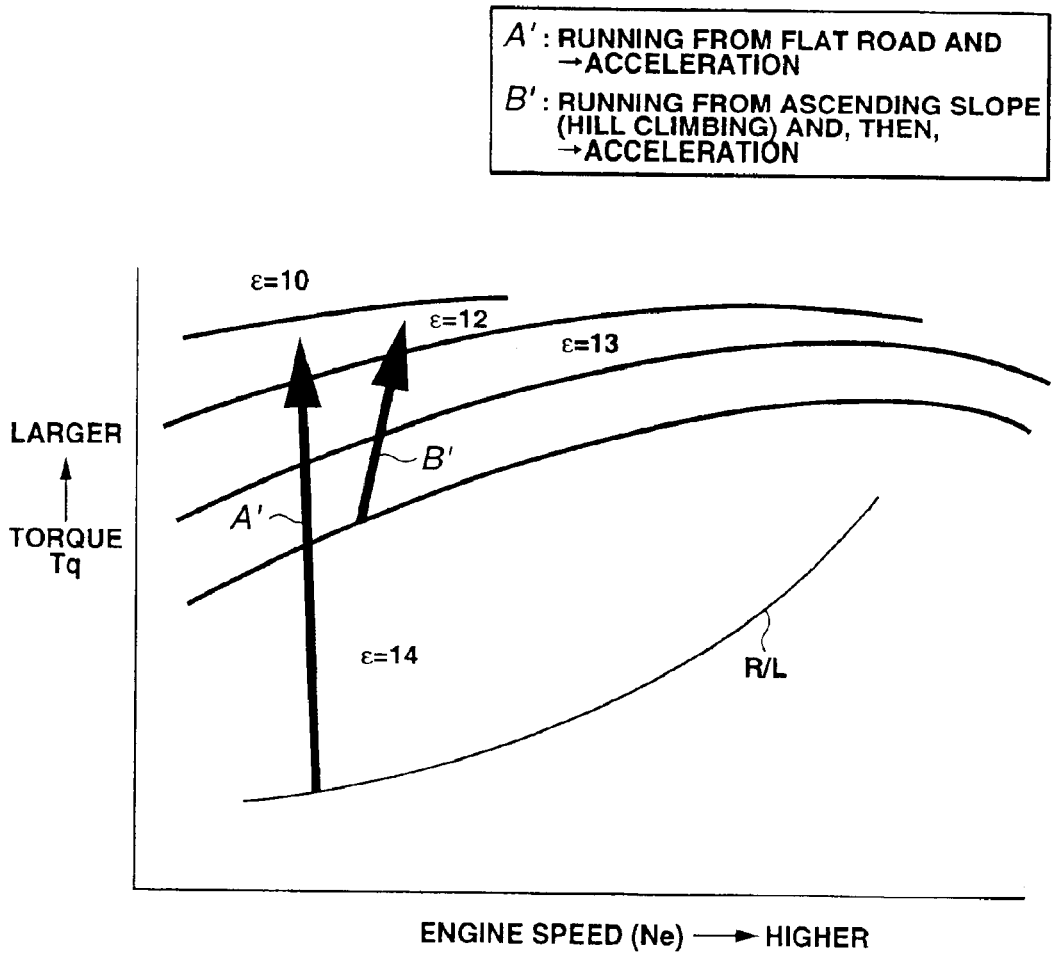
FIG. 14 is a characteristic graph representing the compression ratio control characteristics according to the vehicular running situation in the case of a second embodiment of the compression ratio controlling apparatus according to the present invention.

For example, as denoted by an arrow mark A' of FIG. 14, suppose that a case where the vehicle is accelerated during the vehicular run on the flat road or suppose a case where, after the vehicle runs on the ascending slope (hill climbing), the vehicle runs on the ascending slope (hill climbing), the vehicle runs on the flat road and, after a slight passage of time, the vehicle is accelerated (this case also corresponds to a change in the direction of arrow mark A' of FIG. 14). It is noted that symbol B' shown in FIG. 14 denotes a change in the vehicular run from the run on the ascending slope to the vehicular acceleration.

FIGS. 15A, 15B, 15C, 15D, and 15E show a transient variation in each characteristic value involved in a lapse of time in a case where the vehicle is accelerated to be transferred into a full-load drive after the vehicle has run for a long period of time on the flat road. It is noted that, in this example, a middle through high load drive such as the vehicular run on a moderate ascending slope before the vehicular run on the flat road is assumed to be carried out. During the ascending slope run at the initial time described above, the temperature surrounding the combustion chamber such as the piston crown surface temperature Tp is varied in an upward direction, the intake air-fuel mixture is accordingly heated, and its temperature is raised. However, if a gradient of the ascending slope is relatively moderate (viz., the engine load has still a margin in the engine knock and target compression ratio $\epsilon s$ is set to be high. In a case where the vehicular run is transferred into the full load run under such a condition as described above and, after the short period of time, such a condition as the sudden acceleration occurs, piston crown surface temperature Tp is not yet lowered and, therefore, the engine knock tends to occur. Then, it is necessary for compression ratio $\epsilon$ to be quickly lowered to avoid the occurrence of the engine knock. If the reduction control of compression ratio $\epsilon$ is delayed, ignition timing IT needs to be retarded to a large degree to avoid the knock. Hence, a remarkable reduction in the torque unavoidably occurs. However, the compression ratio control is not always under such a strict condition as described above. In this example shown in FIGS. 15A through 15E, in which the vehicle runs on the ascending slope, thereafter, the vehicle runs on the flat road for a relatively long period of time (for example, several ten seconds), and the vehicle is under the sudden acceleration. Hence, when the vehicle is transferred into the abrupt acceleration, the combustion chamber wall temperature such as the piston crown surface temperature Tp is already reduced. Hence, even if compression ratio $\epsilon$ is high, an immediate engine knock will not occur. It is natural that, since the temperature such as a piston crown surface Tp is raised for a time duration such as several seconds, it is necessary to reduce compression ratio $\epsilon$ toward an appropriate value corresponding to the engine load. However, the reduction in compression ratio $\epsilon$ involves the reduction in the thermal efficiency of the engine. Hence, it is desirable to maintain the high compression ratio as long as possible for a time duration until the temperature surrounding the combustion chamber such as the piston crown surface temperature Tp is raised.

In the second embodiment, after the engine condition is transferred from the low load drive to the high load drive, a predetermined time delay (lag) denoted by $\tau s$2 (as shown in FIG. 15D) is provided so that the compression ratio control is started toward the target compression ratio, viz., the predetermined low compression ratio upon the passage of time corresponding to the delay of $\tau s$2. This compression ratio control causes compression ratio $\epsilon$ to be reached to target compression ratio $\epsilon s$ during the high load after a predetermined period of time $\tau_{02}$ from a time at which the transitional variation in the engine load described above occurs. It is noted that broken lines shown in FIGS. 15B, 15C, and 15D denote their characteristics when compression ratio $\epsilon$ is quickly (speedily) reduced. The difference in ignition timing IT between the characteristics denoted by the dot line and solid line shown in FIG. 15C indicates a difference in a demanded advance angle. In addition, the level of the engine knock in any case of the reduction in compression ratio falls within the allowable limit.

As shown in FIGS. 15A through 15E, piston crown surface temperature Tp is abruptly raised at a high gradient during the sudden acceleration and, accordingly, the intake air-fuel mixture temperature within the cylinder block is raised. Hence, the level of the knock is raised. It is necessary to reduce present compression ratio $\epsilon$ to an appropriate target compression ratio during the high load (low compression ratio) after the passage of time of several seconds. During this time, a torque improvement corresponding to an improvement in the thermal efficiency is obtained. On the other hand, FIGS. 16A through 16E show another case where the vehicular running time duration for which the vehicle runs on the flat road is relatively short and the vehicular driving mode is immediately transferred to the sudden acceleration (or the vehicular run on the abrupt (steep) ascending slope.

In this case, no margin time of time delay as described above with reference to FIGS. 15A through 15E is provided. The compression ratio is immediately varied toward target compression ratio $\epsilon s$ as denoted by a solid line of FIG. 16D without time margin. In details, before a sufficient reduction in the combustion chamber wall temperature (piston crown surface temperature Tp) occurs, the engine load is transferred to the high load region in which the condition such that the knock occurs is more strict, Hence, unless a speedy (quick) reduction in compression ratio $\epsilon$, the knock is developed. Along with the occurrence of knock, the retardation of the ignition timing is unavoidably needed. Consequently, the torque is remarkably reduced. As described above, each possible value of predetermined period of time $\tau_{02}$ from a time point at which the transient state of the vehicular run occurs to a time point at which the compression ratio has reached to the target compression ratio and time delay $\tau_{s2}$ from the time point at which the transient state occurs to the time point at which the change in the compression ratio is started (as shown in FIG. 15D) is dependent upon combustion chamber wall temperature Tc (or piston crown surface temperature Tp). As the combustion chamber wall temperature becomes low, predetermined time $\tau_{02}$ or delay time $\tau_{s2}$ can largely be given.

Hence, in the same way as described in the first embodiment, on the basis of the combustion chamber wall temperature directly detected or estimated or the driving history immediately before the transient state occurs, delay time $\tau_{s2}$ may variably be set.

Figure 19:
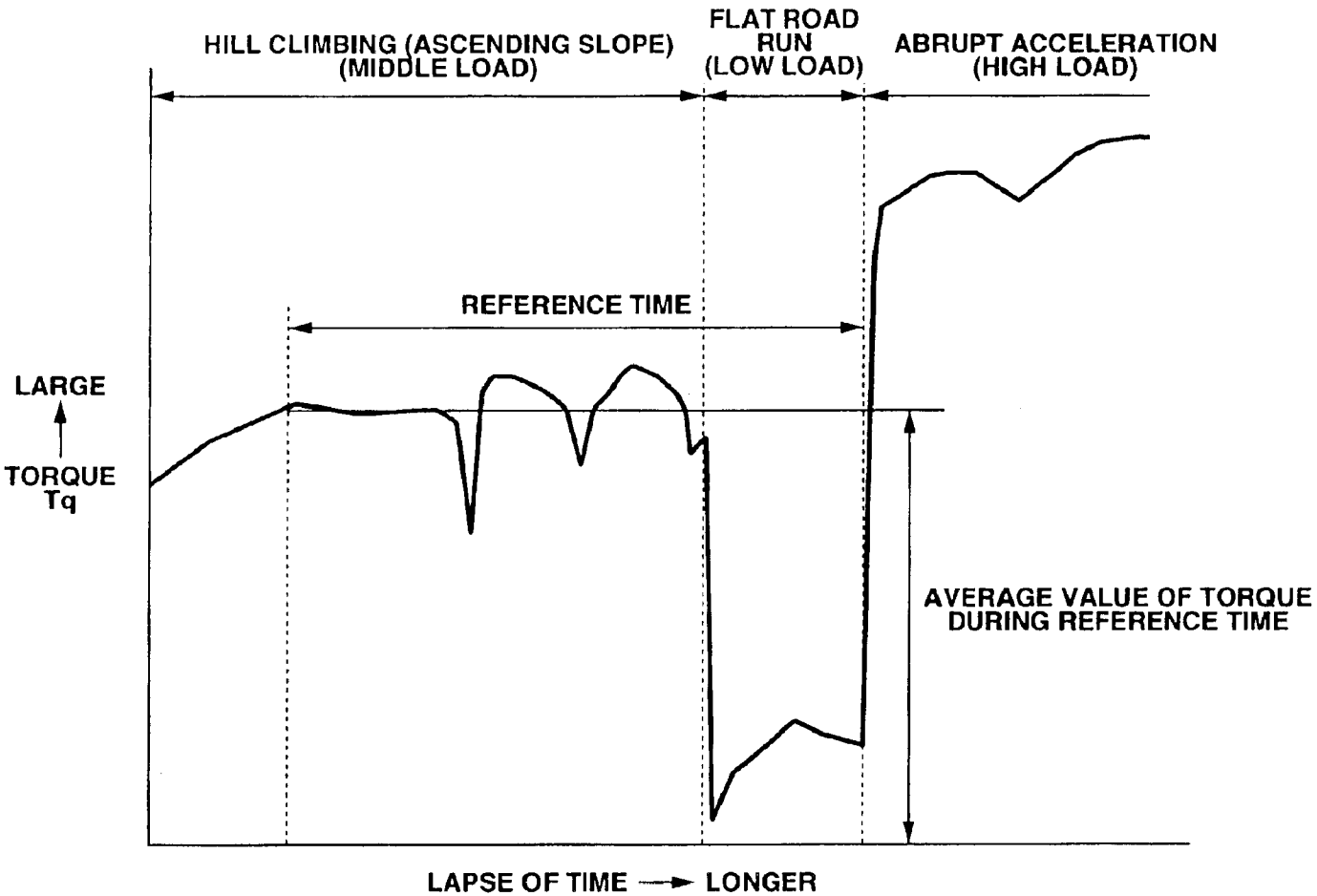
FIG. 19 is an explanatory view for explaining a derivation of an average load percentage (rate) Pm2 in the case of the second embodiment.

FIG. 19 shows an example of the driving history immediately before the transient state described above occurs. An average load percentage (rate) Pm2 is derived from a variation in the torque (load) at the predetermined period of time (a time interval indicated as the reference time) immediately before the vehicular run is transferred to the full load run (high load state) and is a parameter representing a temperature state of the combustion chamber wall temperature. It is, however, noted that, in the second embodiment, average load percentage Pm2 is not simply an average value for a predetermined period of time but is desirably derived according to an approximate expression of a function with the driving history described above taken into consideration. In other words, although the simple average value is the same, it may be considered that the piston crown surface temperature Tp during the lower load immediately before the engine load falls in the full (high) load state. Therefore, it is necessary to reflect such a history as described above.

Figure 20:
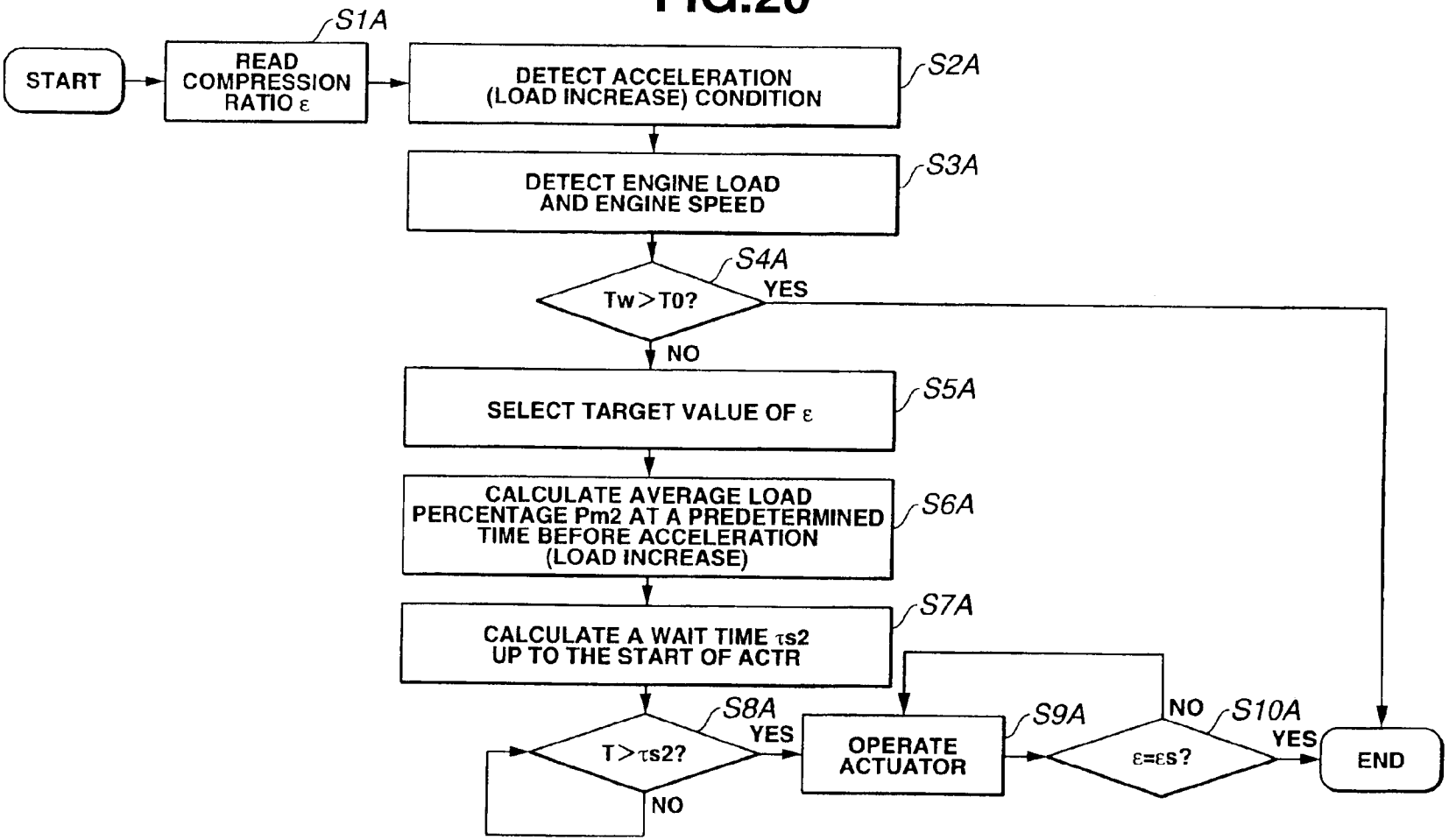
FIG. 20 is an operational flowchart representing a procedure of the compression ratio control executed in the second embodiment in which a delay time is provided during an vehicular acceleration.

FIG. 20 shows an example of a flowchart to achieve the above-described compression ratio control in the case of the second embodiment. FIG. 20 shows a series of processes when the engine load is transferred from the low load region to the high load region. At a step S1A, ECU 4 reads map 5 of target compression ratio. At a step S2A, ECU 4 detects whether the acceleration condition (load increase) is established. This step S2A is executed in a subroutine (not shown) according to, for example, opening angle of the accelerator pedal. When the acceleration condition is established, the routine shown in FIG. 20 goes to a step S3A. At a step S3A, ECU 4 detects the engine load and engine speed. At a step S4A, ECU 4 determines whether coolant temperature Tw is higher than predetermined temperature T0. If Tw>T0 (Yes) at step S4A, ECU 4 determines that the engine is under the overheat state and the compression ratio control is not executed. If Tw≦T0 (No) at step S4A, ECU 4 determines that no overheat state occurs and the routine goes to a step S5A. It is noted that the acceleration condition may be detected on the basis of the engine load and engine speed derived at step S3A. At step S5A, ECU 4 reads target compression ratio $\epsilon s$ corresponding to the driving condition. At a step S6A, ECU 4 calculates average load percentage Pm2 for the predetermined time (reference time) immediately before the acceleration occurs using the method described with reference to FIG. 19. At a step S7A, ECU 4 derives delay time (wait time) $\tau s_2$ up to a time at which actuator 63 is started to be operated. At a step S8A, ECU 4 determines whether lapse time T from the time at which the acceleration is started is in excess of derived delay time $\tau s_2$. If Yes ($T>\tau s_2$) at step S8A, the operation (drive) of actuator 63 is started at a step S9A. Until compression ratio $\epsilon$ reaches approximately to target compression ratio $\epsilon s$ ($\epsilon=$ or $\approx\epsilon s$), the drive of actuator 63 is continued (a step S10A).

Next, FIGS. 17A through 17E integrally show an example of the compression ratio control executed in an alternative to the second embodiment under the same situation as the case of FIGS. 15A through 15E. In this alternative to the second embodiment, in place of providing delay time $\tau s_2$, the variation speed of compression ratio $\epsilon$ from the target (predetermined) high compression ratio to the (predetermined) target low compression ratio involved in the transfer of the engine load from the low engine load region to the high engine load region, viz., the control speed of actuator 63 is positively delayed so that compression ratio $\epsilon$ has reached to target compression ratio $\epsilon s$ after predetermined period of time $\tau_{02}$. The control speed, in this case, may, desirably, variably be set in accordance with the temperature condition of the combustion chamber wall temperature detected or estimated or the driving history described above.

FIGS. 18A through 18E integrally show an example of the variation from the predetermined high compression ratio to the predetermined low compression ratio in the stepwise manner. In this alternative to the second embodiment, one or a plurality of intermediate target compression ratios are provided between the (predetermined) high target compression ratio before the transfer to the high engine load region and the (predetermined) low target compression ratio before the transfer to the high load region. The compression ratio is varied for each one step along these intermediate target compression ratio(s). In other words, actuator 63 is intermittently driven. The intermediate target compression ratios may fixedly be preset or may sequentially be calculated from the target compression ratios before and after the transfer to the high load region.

Several patterns of delay controls in the variation of the compression ratio may be considered. However, any one of the patterns can obtain the sufficient advantages. It is hardly necessary to completely change according to, for example, the driving condition.

It is noted that, in a turbo charger equipped internal combustion engine whose intake air system is equipped with a turbo charger, there is a possibility that an immediate knock occurs at a transient state of the transfer from the low-load region to the high-load region. Hence, if the turbo charge pressure is equal to or higher than a predetermined turbo charge pressure, it is desirable that the delay control of compression ratio irrespective of the driving history described above is inhibited and compression ratio $\epsilon$ is quickly (speedily) varied to target compression ratio $\epsilon s$.

The entire contents of two Japanese Patent Applications No. 2002-202138 (filed in Japan on Jul. 11, 2002) and No. 2003-189928 (filed in Japan on Jul. 2, 2003) are herein incorporated by reference. The scope of the invention is defined with reference to the following claims.

What is claimed is:

1. A compression ratio controlling apparatus for a spark-ignited internal combustion engine, comprising:

a variable compression ratio mechanism that is enabled to operatively vary a compression ratio of the engine;

a detecting section that detects an engine speed and an engine load; and a compression ratio controlling section that controls the variable compression ratio mechanism on the basis of the detected engine speed and engine load in such a manner that the compression ratio is varied toward a target high compression ratio when the engine load falls in a predetermined low load region and toward a target low compression ratio when the engine load falls in a predetermined high load region, the compression ratio controlling section providing a predetermined delay for a variation in the compression ratio toward one of the target high and low compression ratios at a time at which a transient state of the change in the engine load occurs in accordance with at least one of an engine driving history immediately before the transient state thereof occurs and a wall temperature of a combustion chamber of the engine immediately before the transient state thereof occurs.

2. A compression ratio controlling apparatus for a spark-ignited internal combustion engine as claimed in claim 1, wherein the compression ratio controlling section starts a control of the compression ratio via the variable compression ratio mechanism to be directed toward the target high compression ratio after the transient state occurs after the predetermined delay in time has passed from a time at which the transient state in the change of the engine load occurs.

3. A compression ratio controlling apparatus for a spark-ignited internal combustion engine as claimed in claim 2, wherein a state of a wall temperature of a combustion chamber of the engine when the transient state in the change of the engine load occurs is detected or estimated and, as the wall temperature of the combustion chamber becomes higher, the predetermined delay in time is set to become longer.

4. A compression ratio controlling apparatus for a spark-ignited internal combustion engine as claimed in claim 3, wherein the state of the wall temperature of the combustion chamber is estimated according to the driving history immediately before the transient state occurs.

5. A compression ratio controlling apparatus for a spark-ignited internal combustion engine as claimed in claim 1, wherein the variable compression ratio mechanism comprises a multiple link piston-crank mechanism including; a first link linked to a piston via a piston pin; a second link swingably linked to the first link and rotatably linked to a crank pin portion of an engine crankshaft; and a third link swingably linked to the second link and swingably linked to the second link and swingably supported on an engine body and wherein the compression ratio controlling section varies a position of a fulcrum of the third link of the multiple link piston-crank mechanism with respect to the engine body to perform a variable control of the compression ratio.

6. A compression ratio controlling apparatus for a spark-ignited internal combustion engine as claimed in claim 1, wherein the compression ratio controlling apparatus further comprises an ignition timing controlling section that controls an ignition timing of the engine and an engine knock detecting section detects an engine knock and wherein the ignition timing controlling section retards the ignition timing of the engine when the engine knock detecting section detects the knock.

7. A compression ratio controlling apparatus for a spark-ignited internal combustion engine as claimed in claim 3, wherein the wall temperature of the combustion chamber is detected by a temperature sensor.

8. A compression ratio controlling apparatus for a spark-ignited internal combustion engine, comprising:

a variable compression ratio mechanism that is enabled to operatively vary a compression ratio of the engine;

a detecting section that detects an engine speed and an engine load; and a compression ratio controlling section that controls the variable compression ratio mechanism on the basis of the detected engine speed and engine load in such a manner that the compression ratio is varied toward a target high compression ratio when the engine load falls in a predetermined low load region and toward a target low compression ratio when the engine load falls in a predetermined high load region, the compression ratio controlling section controlling the variable compression ratio mechanism to vary the compression ratio toward one of the target high and low compression ratios in such a manner that the varied compression ratio reaches to the one of the target high and low compression ratios after a passage of a predetermined period of time from a time at which a transient state of a change in the engine load occurs in accordance with at least one of an engine driving history immediately before the transient state thereof occurs and a wall temperature of a combustion chamber of the engine immediately before the transient state thereof occurs.

9. A compression ratio controlling apparatus for a spark-ignited internal combustion engine as claimed in claim 8, wherein the compression ratio controlling section controls the variable compression ratio mechanism to vary the compression ratio toward the target high compression ratio in such a manner that the varied compression ratio reaches to the target high compression ratio after the passage of the predetermined period of time by delaying a variation speed of the compression ratio which varies toward the target high compression ratio when the engine falls in the predetermined low engine load from the target low compression ratio when the engine falls in the predetermined high engine load.

10. A compression ratio controlling apparatus for a spark-ignited internal combustion engine as claimed in claim 8, wherein the compression ratio controlling section sets at least one intermediate target compression ratio between the target high compression ratio and the target low compression ratio and controls the variable compression ratio mechanism to vary the compression ratio in a stepwise manner along the intermediate target compression ratio.

11. A compression ratio controlling apparatus for a spark-ignited internal combustion engine as claimed in claim 8, wherein a state of the wall temperature of the combustion chamber of the engine when the transient state in the change of the engine load occurs is detected or estimated and, as the wall temperature of the combustion chamber becomes higher, the predetermined period of time is set to become longer.

12. A compression ratio controlling apparatus for a spark-ignited internal combustion engine as claimed in claim 8, wherein the compression ratio controlling apparatus further comprises a coolant temperature detecting section to detect a temperature of a coolant of the engine and, as the temperature of the engine coolant becomes higher, the predetermined period of time is set to become longer.

13. A compression ratio controlling apparatus for a spark-ignited internal combustion engine as claimed in claim 8, wherein the compression ratio controlling section controls the variable compression ratio mechanism to vary the compression ratio toward the target low compression ratio in such a manner that the varied compression ratio reaches to the target low compression ratio after the passage of the predetermined period of time from the time at which a transient change in the engine load from the predetermined low load region to the predetermined high load region occurs.

14. A compression ratio controlling apparatus for a spark-ignited internal combustion engine as claimed in claim 13, wherein the compression ratio controlling section controls the compression ratio mechanism to vary the compression ratio toward the target low compression ratio in such a manner that the varied compression ratio reaches to the target high compression ratio after the passage of the predetermined period of time by delaying a variation speed of the compression ratio which varies toward the target low compression ratio when the engine load falls into the predetermined high engine load region from the target high compression ratio when the engine falls in the predetermined low engine load region.

15. A compression ratio controlling apparatus for a spark-ignited internal combustion engine as claimed in claim 13, wherein the compression ratio controlling section sets at least one intermediate target compression ratio between the target low compression ratio and the target high compression ratio and controls the variable compression ratio mechanism to vary the compression ratio in a stepwise manner to vary the compression ratio along the intermediate target compression ratio toward the target low compression ratio when the transient state of the change in the engine load of the change in the engine load from the predetermined low load region to the predetermined high load region occurs.

16. A compression ratio controlling apparatus for a spark-ignited internal combustion engine as claimed in claim 13, wherein the compression ratio controlling section starts a control of the compression ratio via the variable compression ratio mechanism to be directed toward the target low compression ratio after a predetermined delay in time has passed from a time at which the transient state in the change of the engine from the predetermined high load region to the predetermined low load region occurs.

17. A compression ratio controlling apparatus for a spark-ignited internal combustion engine as claimed in claim 16, wherein a state of the wall temperature of the combustion chamber of the engine when the transient state in the change of the engine load occurs is detected or estimated and, as the wall temperature of the combustion chamber becomes lower, the predetermined delay time is set to become longer.

18. A compression ratio controlling apparatus for a spark-ignited internal combustion engine as claimed in claim 13, wherein a state of the wall temperature of the combustion chamber of the engine when the transient state in the change of the engine load from the predetermined low load region to the predetermined high load region occurs is detected or estimated and, as the wall temperature of the combustion chamber becomes lower, the predetermined period of time is set to become longer.

19. A compression ratio controlling apparatus for a spark-ignited internal combustion engine as claimed in claim 13, wherein the compression ratio controlling apparatus further comprises a coolant temperature detecting section to detect a temperature of a coolant of the engine and, as the temperature of the engine coolant becomes higher, the predetermined period of time is set to become shorter.

20. A compression ratio controlling apparatus for a spark-ignited internal combustion engine as claimed in claim 13, wherein a turbo charger is equipped in an intake air system of the engine and, when a turbo charge pressure is equal to or higher than a predetermined turbo charge pressure, the compression ratio is quickly varied without the predetermined period of time during the transient state of the change in the engine load from the predetermined low engine load region to the predetermined high engine load region.

21. A compression ratio controlling method for a spark-ignited internal combustion engine, the engine comprising:

a variable compression ratio mechanism that is enabled to vary a compression ratio of the engine, and the compression ratio controlling method comprising:

detecting an engine speed and an engine load;

controlling the variable compression ratio mechanism on the basis of the detected engine speed and engine load in such a manner that the compression ratio is varied toward a target high compression ratio when the engine load falls in a predetermined low load region and toward a target low compression ratio when the engine load falls in a predetermined high load region; and providing a predetermined delay in a variation in the compression ratio toward one of the target high and low compression ratios at a time at which a transient state of a change in the engine load occurs in accordance with at least one of an engine driving history immediately before the transient state thereof and a wall temperature of a combustion chamber of the engine immediately before the transient state thereof occurs.

* * * * *